US012276430B2

(12) United States Patent
Fervoy et al.

(10) Patent No.: US 12,276,430 B2
(45) Date of Patent: Apr. 15, 2025

(54) HVAC EQUIPMENT SCREENING SYSTEMS

(71) Applicant: Schwab-Vollhaber-Lubratt, Inc., Roseville, MN (US)

(72) Inventors: Peter R. Fervoy, St. Paul, MN (US); Howard S. Hoffman, Edina, MN (US); Cyril J. Silberman, Miami Beach, FL (US); James M. Lubratt, Shoreview, MN (US)

(73) Assignee: Schwab-Vollhaber-Lubratt, Inc., Roseville, MN (US)

( * ) Notice: Subject to any disclaimer, the term of this patent is extended or adjusted under 35 U.S.C. 154(b) by 0 days.

(21) Appl. No.: 18/824,809

(22) Filed: Sep. 4, 2024

(65) Prior Publication Data

US 2025/0075921 A1 Mar. 6, 2025

Related U.S. Application Data

(60) Provisional application No. 63/580,512, filed on Sep. 5, 2023.

(51) Int. Cl.

| | |
|---|---|
| ***F24F 1/50*** | (2011.01) |
| ***F24F 1/58*** | (2011.01) |
| *A47G 5/00* | (2006.01) |

(52) U.S. Cl.

CPC ..... *F24F 1/58* (2013.01); *A47G 5/00* (2013.01); *F24F 2221/16* (2013.01)

(58) Field of Classification Search

CPC ..... E04B 7/18; E04B 2/58; F24F 1/58; F24F 2221/16; A47G 5/00

See application file for complete search history.

(56) References Cited

U.S. PATENT DOCUMENTS 2,955,520 A 10/1960 Mccullough
3,006,498 A * 10/1961 Thiede ..... F24F 1/58 220/255

(Continued)

FOREIGN PATENT DOCUMENTS

CA 2955520 A1 7/2017

OTHER PUBLICATIONS

Uni-Systems, LLC "En-Fold retractable awning at Juvia Miami" https://www.youtube.com/watch?v=IOMWBhTWdd4, Published on Youtube Jul. 16, 2021, 3 pages of still images of video.

(Continued)

*Primary Examiner* — Babajide A Demuren
(74) *Attorney, Agent, or Firm* — Fredrikson & Byron, P.A.

(57) ABSTRACT

Some embodiments provide a rooftop HVAC assembly including HVAC equipment and a screening system. In the present embodiments, the HVAC equipment is mounted operably on a roof of a building and the screening system is assembled operatively so as to surround the HVAC equipment. The screening system includes a screen panel that is adjustable between a lower, closed position and an upper, open position, e.g., by moving at least part of the screen panel selectively upwardly or downwardly. Further, some embodiments provide a screening system for a rooftop HVAC assembly comprising HVAC equipment and the screening system. In the present embodiments, the screening system is configured to be operatively assembled so as to surround the HVAC equipment when mounted operably on a roof of a building.

35 Claims, 16 Drawing Sheets

(56) References Cited

U.S. PATENT DOCUMENTS

| | | | | |
|---|---|---|---|---|
| D243,853 | S | 3/1977 | Ejchorszt | |
| 4,242,876 | A | 1/1981 | Cooper et al. | |
| 4,799,986 | A | 1/1989 | Janni | |
| 4,953,328 | A * | 9/1990 | Sewell | F24F 1/58 52/473 |
| 5,029,452 | A | 7/1991 | Mourabet et al. | |
| 5,186,528 | A | 2/1993 | Schardt et al. | |
| 5,315,799 | A | 5/1994 | Cullinan | |
| 5,664,384 | A | 9/1997 | Cullinan | |
| 5,862,637 | A | 1/1999 | Bruce | |
| 6,082,054 | A | 7/2000 | Silberman et al. | |
| 6,138,993 | A * | 10/2000 | Mitchell, Jr. | F24F 1/58 256/25 |
| 6,205,719 | B1 | 3/2001 | Bruce | |
| 6,367,206 | B1 | 4/2002 | Silberman et al. | |
| 6,415,556 | B1 | 7/2002 | Silberman et al. | |
| 6,430,954 | B1 * | 8/2002 | Smith | F24F 1/58 206/320 |
| 6,698,141 | B2 | 3/2004 | Silberman et al. | |
| 6,718,696 | B2 | 4/2004 | Silberman et al. | |
| 6,758,015 | B2 | 7/2004 | Clasen et al. | |
| 6,789,360 | B2 | 9/2004 | Silberman et al. | |
| 7,000,362 | B1 | 2/2006 | Cullinan | |
| 7,059,088 | B2 | 6/2006 | Lattanzio | |
| 7,322,154 | B2 | 1/2008 | Forbis, Sr. et al. | |
| 7,594,360 | B2 | 9/2009 | Silberman et al. | |
| 7,707,798 | B1 | 5/2010 | Cullinan | |
| 8,186,107 | B2 | 5/2012 | Silberman et al. | |
| 8,282,452 | B2 | 10/2012 | Grigsby et al. | |
| 8,800,214 | B2 | 8/2014 | Doherty et al. | |
| 11,054,172 | B2 * | 7/2021 | Suriya Prakash | F24F 1/58 |
| 11,203,867 | B2 | 12/2021 | Ferland | |
| 2006/0117668 | A1 | 6/2006 | Forbis et al. | |
| 2008/0083239 | A1 * | 4/2008 | Meyer | F24F 13/20 62/305 |
| 2009/0019789 | A1 * | 1/2009 | Gephart | F24F 13/20 256/25 |
| 2013/0161215 | A1 * | 6/2013 | Dowdy | F24F 1/58 206/320 |
| 2017/0211272 | A1 | 7/2017 | Cullinan et al. | |
| 2019/0242122 | A1 | 8/2019 | Ferland | |
| 2021/0262225 | A1 | 8/2021 | Mcarthur | |
| 2021/0404700 | A1 | 12/2021 | Montoya | |
| 2022/0163231 | A1 | 5/2022 | Kelly et al. | |
| 2023/0349588 | A1 * | 11/2023 | Willis, Sr. | E04H 15/02 |

OTHER PUBLICATIONS

Envisor, "Envisor Screening Systems Brochure", City Scapes, Dated Jul. 2023, pp. 12.

uni-systems.com "En-Fold Retractable Awning Specifications", website downloaded from: https://web.archive.org/web/20230328081324/https://www.uni-systems.com/technical-detail, Wayback Machine retrieved from Mar. 28, 2023, 3 Pages.

Mcmaster-Carr "Constant-Force Spring" http://www.mcmaster.com, Part No. 9293K58, 2022, pp. 2.

Marsh, "Build a Parallel Straightedge Drafting Table!" https://www.Instructables.com, Retrieved The Wayback Machine—https://web.archive.org/web/20230603213748/https://www.instructables.com/Build-a-Parallel-Straightedge-Drafting-Table/, Dated Jun. 3, 2023, pp. 7.

Gibraltar, "Gibraltar Brands Horizontal U Hook MFR #77863884" Retrieved Dec. 2, 2024, https://www.motion.com/products/sku/06287836, On sale before Sep. 5, 2023, pp. 2.

* cited by examiner

HVAC EQUIPMENT SCREENING SYSTEMS

RELATED APPLICATIONS

This disclosure claims priority to U.S. provisional application 63/580,512, filed on Sep. 5, 2023, the entire contents of which are hereby incorporated by reference.

TECHNICAL FIELD

The present disclosure relates generally to HVAC equipment. More specifically, this disclosure relates to screening systems for HVAC equipment.

BACKGROUND

HVAC equipment is often mounted on the roofs of commercial buildings. Various types of HVAC equipment are used, such as packaged rooftop units (RTUs) or other equipment which may include heat pumps and/or other air conditioning, heating, or ventilating components. In some cases, rooftop equipment may be visible to passersby on the ground, to people on nearby buildings, or both. In such cases, the rooftop equipment may be considered unsightly. Some building codes even mandate that rooftop equipment be hidden from view.

It would be desirable to provide a screening system for rooftop HVAC equipment. It would be especially desirable to provide a screening system with one or more screen panels that can be selectively closed and opened to give workers access to the HVAC equipment. For example, it would be desirable to provide a screening system with one or more screen panels that can be selectively closed and opened without requiring disassembly of the system and/or where the opening and closing operations are simple and reliable. Moreover, it would be desirable to provide a system of this nature where the resulting access to the HVAC equipment is convenient and safe for workers. Additionally or alternatively, it would be desirable to provide a certain type of convenient adjustability in a mounting assembly that attaches a screening system to rooftop HVAC equipment.

SUMMARY

In certain embodiments, the invention provides a rooftop HVAC assembly that includes HVAC equipment and a screening system. In the present embodiments, the HVAC equipment is mounted operably on a roof of a building, and the screening system is assembled operatively so as to surround the HVAC equipment. The screening system includes a screen panel that is adjustable between a lower, closed position and an upper, open position by moving at least part of the screen panel along an upright track. Preferably, the screen panel is adjustable, without any disassembly of the screening system, between the lower, closed position and the upper, open position by moving at least part of the screen panel along the upright track.

Some embodiments of the invention provide a screening system for a rooftop HVAC assembly that includes HVAC equipment and the screening system. In the present embodiments, the screening system is configured to be operatively assembled so as to surround the HVAC equipment when mounted operably on a roof of a building. The screening system includes a screen panel and an upright track. In the present embodiments, the screening system is configured to be operatively assembled such that the screen panel is adjustable between a lower, closed position and an upper, open position by moving at least part of the screen panel along the upright track. Preferably, the screening system is configured to be operatively assembled such that the screen panel is adjustable, without any disassembly of the screening system, between the lower, closed position and the upper, open position by moving at least part of the screen panel along the upright track.

Certain embodiments of the invention provide a rooftop HVAC assembly that includes HVAC equipment and a screening system. In the present embodiments, the HVAC equipment is mounted operably on a roof of a building, and the screening system is assembled operatively so as to surround the HVAC equipment. In some of the present embodiments, the HVAC equipment has a length and a width, and the screening system includes two length walls and two width walls, with the two length walls extending alongside the length of the HVAC equipment, and the two width walls extending alongside the width of the HVAC equipment. In embodiments of this nature, the screening system preferably includes: (i) one or more adjustable-length beams extending from the HVAC equipment to a first of the two length walls, and (ii) one or more adjustable-length beams extending from the HVAC equipment to a first of the two width walls. Preferably, the adjustable-length beams are tubes configured to telescope to provide length adjustability.

The details of one or more examples are set forth in the accompanying drawings and the descriptions below. Other features, objects, and advantages will be apparent to skilled artisans given the present descriptions, drawings, and claims.

BRIEF DESCRIPTION OF DRAWINGS

The following drawings are illustrative of particular examples of the present invention and therefore do not limit the scope of invention. The drawings are not necessarily to scale, though embodiments can include the scale illustrated, and are intended for use in conjunction with the explanations in the following detailed description wherein like reference characters denote like elements. Examples of the present invention will hereinafter be described in conjunction with the appended drawings.

DETAILED DESCRIPTION

In a first group of embodiments, the invention provides a rooftop HVAC assembly 10 that includes HVAC equipment 100 and a screening system 200. In some such embodiments, the HVAC equipment 100 is mounted operably on a roof RF of a building, and the screening system is assembled operatively so as to surround the HVAC equipment. Reference is made to the non-limiting example of FIG. 1. In some cases, the screening system 200 surrounds the HVAC equipment 100 on four sides, e.g., entirely about 360 degrees. In other cases, however, it may be desirable to only screen the HVAC equipment 100 on one or more (e.g., two or three) sides.

Figure 1:
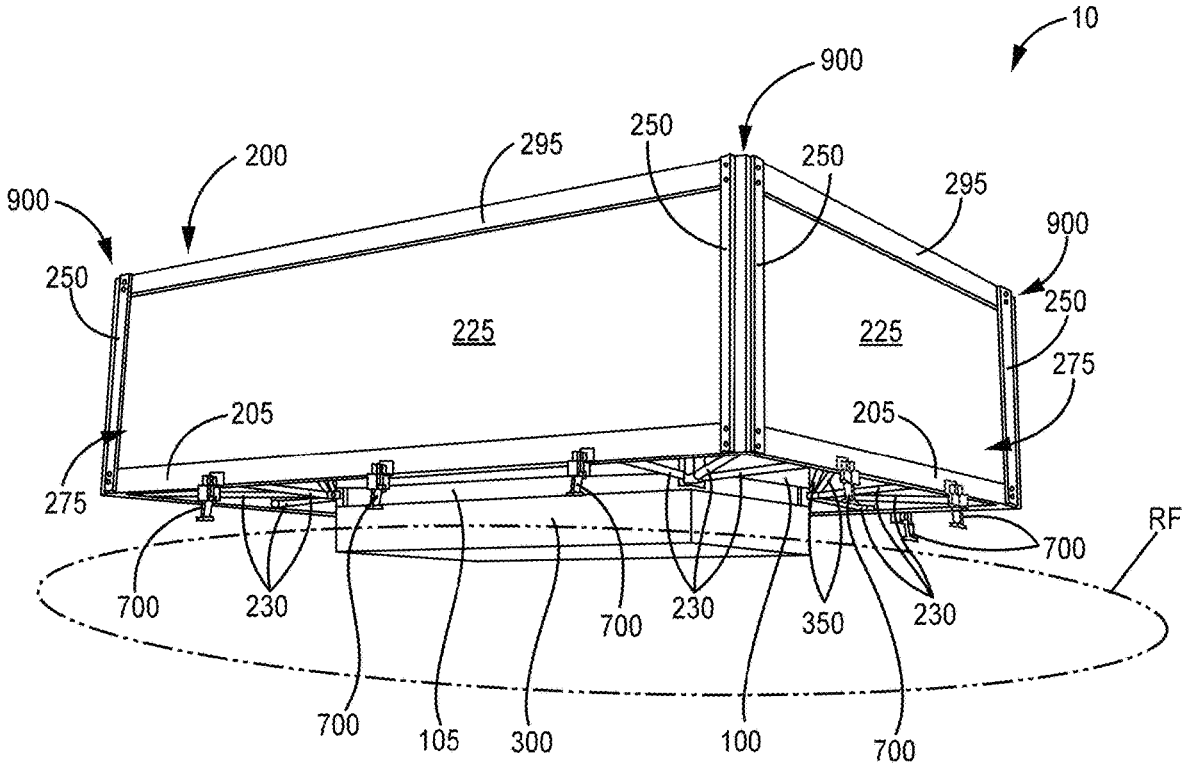
FIG. 1 is a schematic perspective view of a rooftop HVAC assembly mounted operably on a roof of a building, the rooftop HVAC assembly includes HVAC equipment and a screening system in accordance with certain embodiments of the present invention.

With continued reference to FIG. 1, the illustrated screening system 200 has four sides (e.g., four walls) that collectively delineate a generally rectangular configuration. It is to be appreciated, however, that the screening system can have different configurations (e.g., more than four sides) depending upon the particular configuration of the HVAC equipment.

In the present group of embodiments, the screening system 200 includes a screen panel 275 that is adjustable between a lower, closed position and an upper, open position. In more detail, the screen panel 275 preferably is adjustable between the lower, closed position and the upper, open position by moving at least part of the screen panel (e.g., a base rail 205 thereof) selectively upwardly or downwardly, optionally along an upright track. This is perhaps best appreciated by referring to FIGS. 2, 5, 6, 13, and 14. Here, an optional upright track is defined between left and right upright track members 250. In more detail, the screen panel 275 preferably is adjustable between the lower, closed position and the upper, open position by moving at least part of the screen panel vertically (or at least generally vertically, e.g., substantially vertically).

In the embodiments illustrated, the screen panel 275 is adjustable, without any disassembly of the screening system 200, between the lower, closed position and the upper, open position. If desired, however, there can be some disassembly involved, such as removing one or more fasteners to unlock the screen panel, before moving it from one position to the other.

Preferably, the screen panel 275 has an uppermost extent that is at the same elevation whether the screen panel is in the lower, closed position or the upper, open position. This can be appreciated, for example, by comparing FIGS. 5 and 6. Additionally or alternatively, an uppermost extent of the screening system 200 (e.g., a top rail 295 of the framework) can optionally be at the same elevation whether the screen panel 275 is in the lower, closed position or the upper, open position.

In some preferred embodiments, an uppermost extent of the screening system 200 (e.g., an uppermost extent of its walls and framework) is at the same elevation or a higher elevation than an uppermost extent (e.g., a top) of the HVAC equipment 100. In the embodiments illustrated, the upper extent of the screening system 200 is at a higher elevation than the top of the HVAC equipment 100. This, however, is not required. In other cases, sufficient screening may be provided by a shorter screening system, especially considering the perspective from which passersby on the ground may observe the screening system.

The screen panel 275 preferably comprises a fabric screen 225. Various materials can be used for the fabric screen 225, such as polyester or polytetrafluoroethylene. As one example, a PVC coated polyester fabric can be used. One suitable material is the LAC 650 SL (20 oz) fabric that is commercially available from Saint Clair Textiles (Saint-Clair-de-la-Tour, France). In some cases, the fabric screen is formed of an opaque fabric (e.g., of polyester or polytetrafluoroethylene) that is substantially impervious to wind. In other cases, the fabric screen is formed of a netting or mesh (e.g., insect screen material) that allows wind to pass through readily. In certain embodiments of this nature, the fabric screen comprises two layers of netting or mesh separated by a desired gap distance (optionally about an inch) so that wind is allowed to pass readily therethrough while still somewhat blocking (or at least obscuring) the HVAC equipment from view. In other cases, the fabric screen is formed of acoustical fabric to reduce noise from the HVAC equipment.

Preferably, the screening system 200 is configured such that the fabric screen 225 is retained in a taut position when the screen panel 275 is in the lower, closed position. This is the case for the fabric screen 225 of each illustrated screen panel 275. In the embodiments illustrated, a latch system is provided to secure the screen panel 275 in the lower, closed position (preferably so as to hold the fabric screen 225 in a taut position). More will be said of this later.

In some embodiments, the screening system 200 is configured such that the fabric screen 225 is folded over itself when the screen panel 200 is in the upper, open position. This is shown in the non-limiting examples of FIGS. 6 and 14. In more detail, the illustrated fabric screen 225 when in this position has two ends secured adjacent a top of the screening system 200 such that a length of the fabric screen hangs downwardly from one end and loops back up to the other end. Thus, where the screen panel 275 is shown in the upper, open position (see FIGS. 6 and 14), the illustrated fabric screen 225 is hanging in a loop (with an open doorway thereby created below the loop). It can thus be appreciated that, moving upwardly from the bottom of the loop, two thicknesses of the illustrated fabric screen are arranged in a side-by-side configuration. In certain alternative embodiments, the fabric screen is rolled-up (e.g., on a tensioned reel) when the screen panel is in the upper, open position.

Thus, the fabric screen 225 may be under more tension when the screen panel 275 is in the lower, closed position than when in the upper, open position. Additionally or alternatively, the fabric screen 225 can optionally be devoid of rigid frame members attached to left and right sides of the fabric screen. For example, left and right edges of the fabric screen 225 can optionally be free edges.

Preferably, the fabric screen 225 has an upper end and a lower end, and the screen panel 275 further comprises a base rail 205, which can advantageously be attached to the lower end of the fabric screen. This is shown in FIGS. 1, 2, 4-6, 13, 14, 15, and 16. Here, the screen panel 275 is adjustable between the lower, closed position and the upper, open position by sliding the base rail 205 along the upright track. The base rail 205 can generally be formed of metal, polymer, wood, or composite. Preferably, the base rail 205 comprises aluminum or another lightweight aircraft metal. In certain embodiments, the base rail 205 comprises an aluminum bar of the configuration shown.

As noted above, the screening system 200 preferably includes left and right upright track members 250 defining between them the upright track. The left and right upright track members 250, for example, can each define a channel in which the base rail 205 is slidably received. This is perhaps best seen in FIG. 7.

The screening system 200 preferably comprises a framework that includes a top rail 295 in addition to upright left and right track members 250. In such cases, the upper end of the fabric screen 225 is attached to a top rail 295 of the framework. This is perhaps best seen in FIGS. 1, 2, 4, 5 13, and 15. When provided, the top rail 295 can be a bar, housing, panel, and/or other elongated component.

The illustrated left and right upright track members 250 and top rail 295 can generally be formed of metal, polymer, wood, or composite. Preferably, the left and right upright track members 250 and the top rail 295 each comprise aluminum or another lightweight aircraft metal. In certain embodiments, the left and right upright track members 250 and top rail 295 comprise aluminum bars of the configurations shown.

Figure 12:
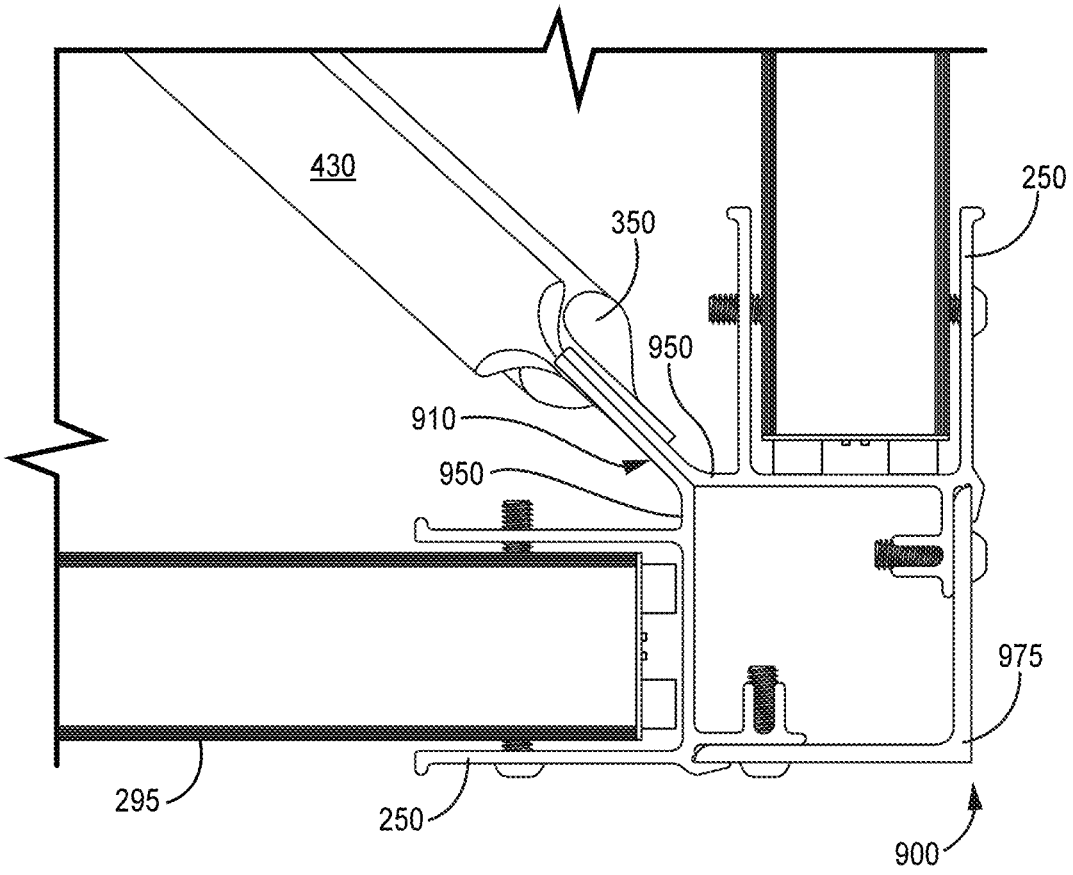
FIG. 12 is a broken-away plan detail view of the first corner region of FIG. 7.
Figure 13:
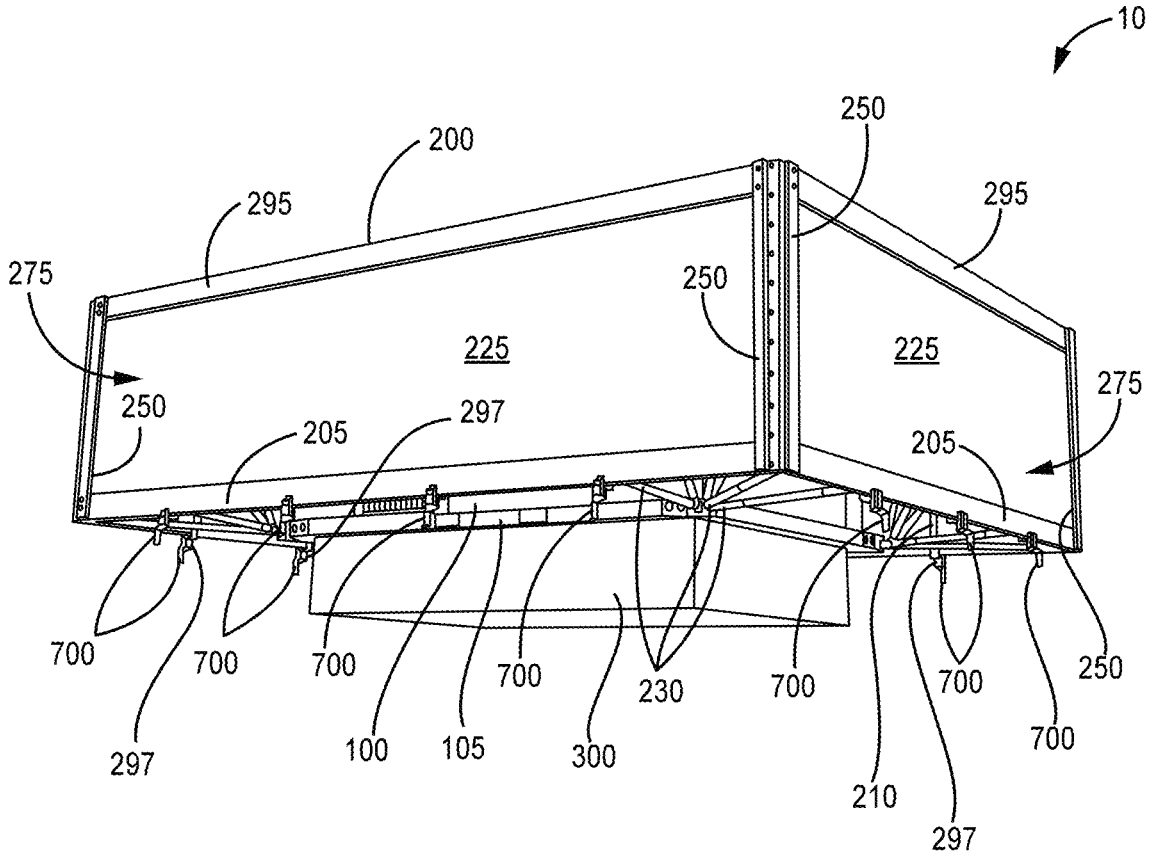
FIG. 13 is another perspective view of the rooftop HVAC assembly of FIG. 2, with the front screen panel shown in the closed position.
Figure 14:
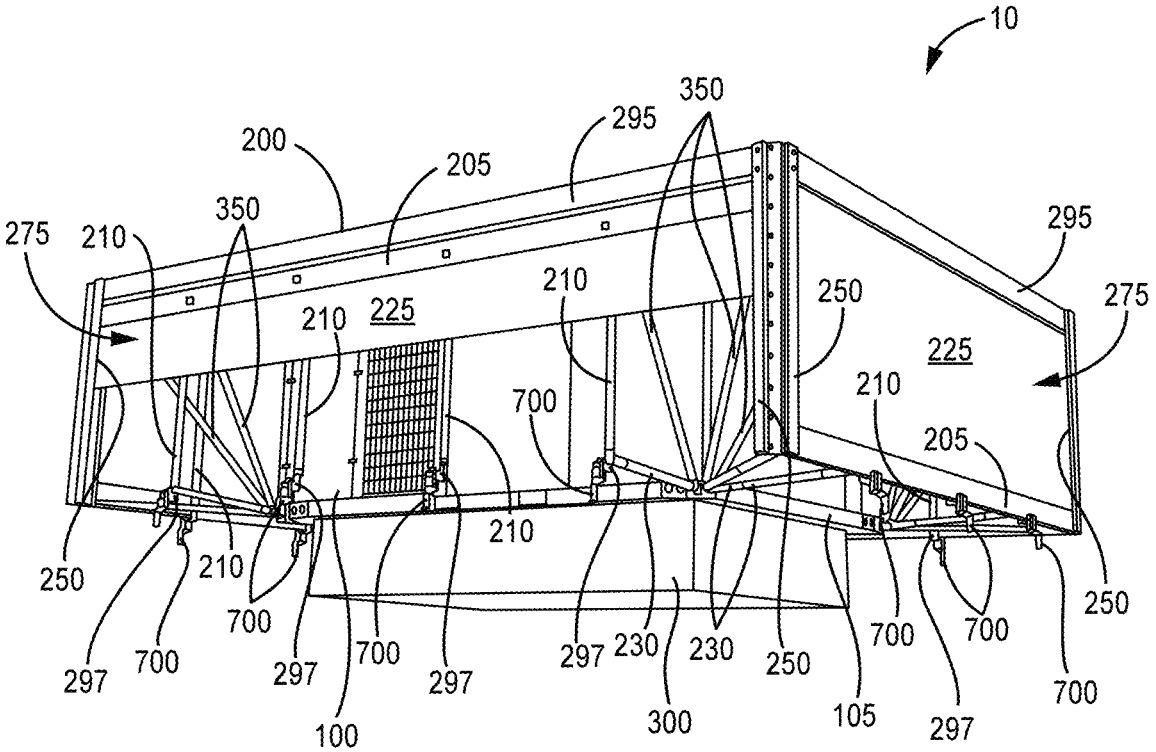
FIG. 14 is still another perspective view of the rooftop HVAC assembly of FIG. 2, with the front screen panel shown in the open position.

FIG. 12 details an advantageous corner extrusion assembly 900 that can optionally be provided to define left and right upright track members 250. Here, a pair of extruded elongated side bodies 950 are assembled together so as to respectively define adjacent left and right upright track members 250 at a corner region of the screening assembly 200. In this particular corner construction, an extruded elongated corner body 975 is assembled together with the pair of extruded elongated side bodies 950 so as to collectively define a corner of the screening assembly 200 and left and right upright track members 250. In the illustrated corner construction, the pair of extruded elongated side bodies 950 when assembled together also define a mounting flange 910 to which one or more support beams 350, 430 are attached.

Figure 2:
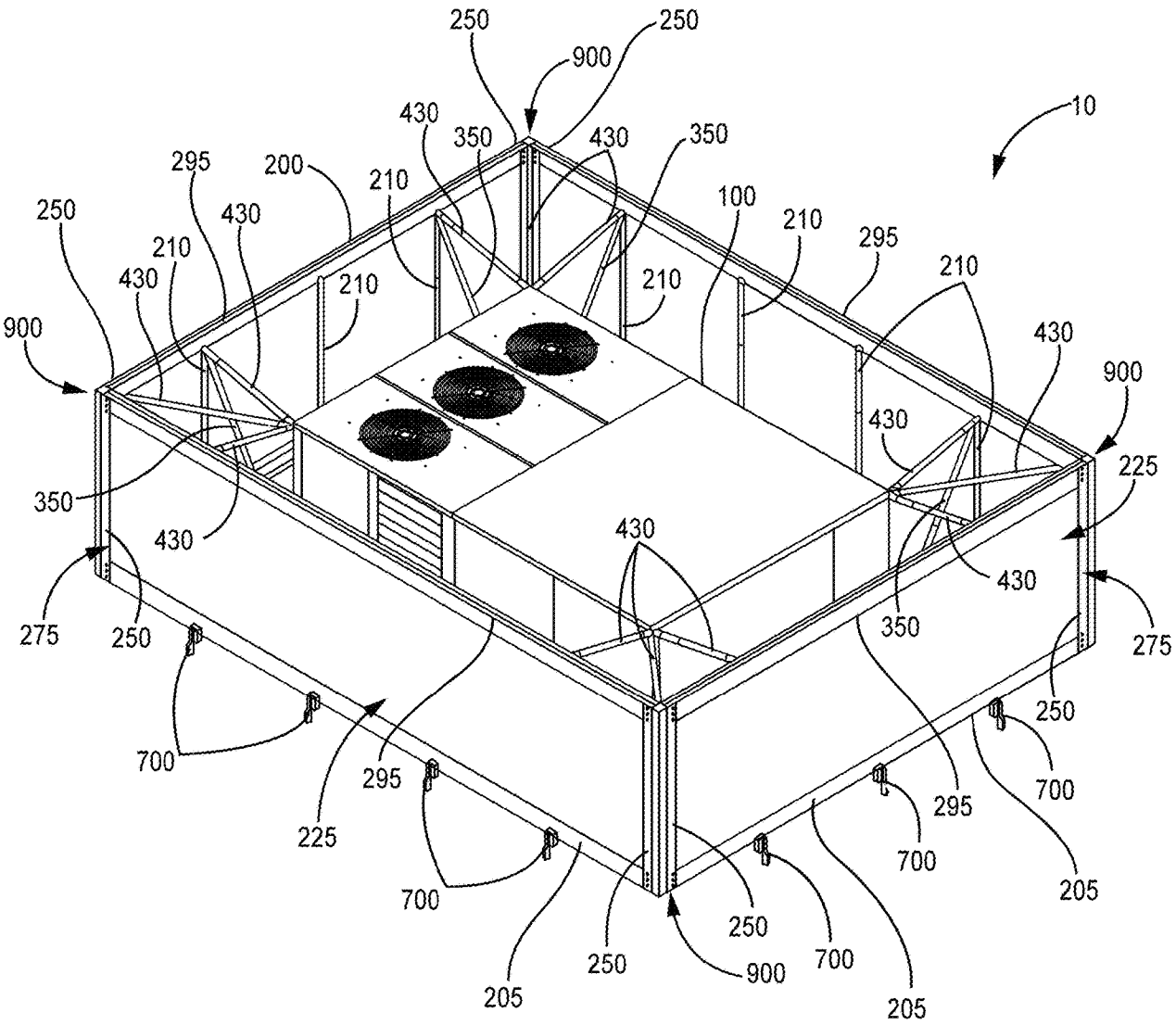
FIG. 2 is a perspective view of a rooftop HVAC assembly that includes HVAC equipment and a screening system in accordance with certain embodiments of the present invention.
Figure 3:
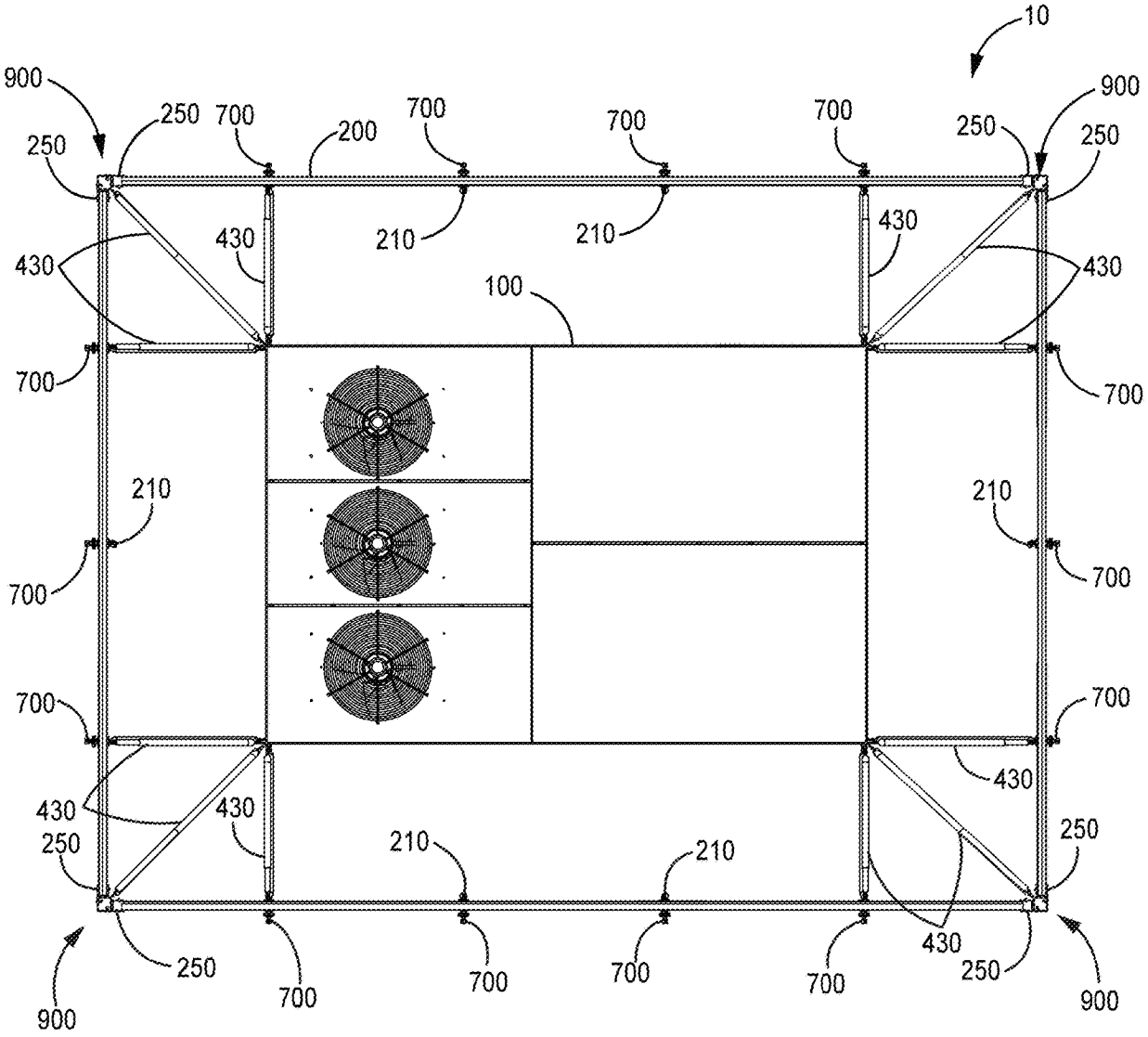
FIG. 3 is a plan view of the rooftop HVAC assembly of FIG. 2.
Figure 7:
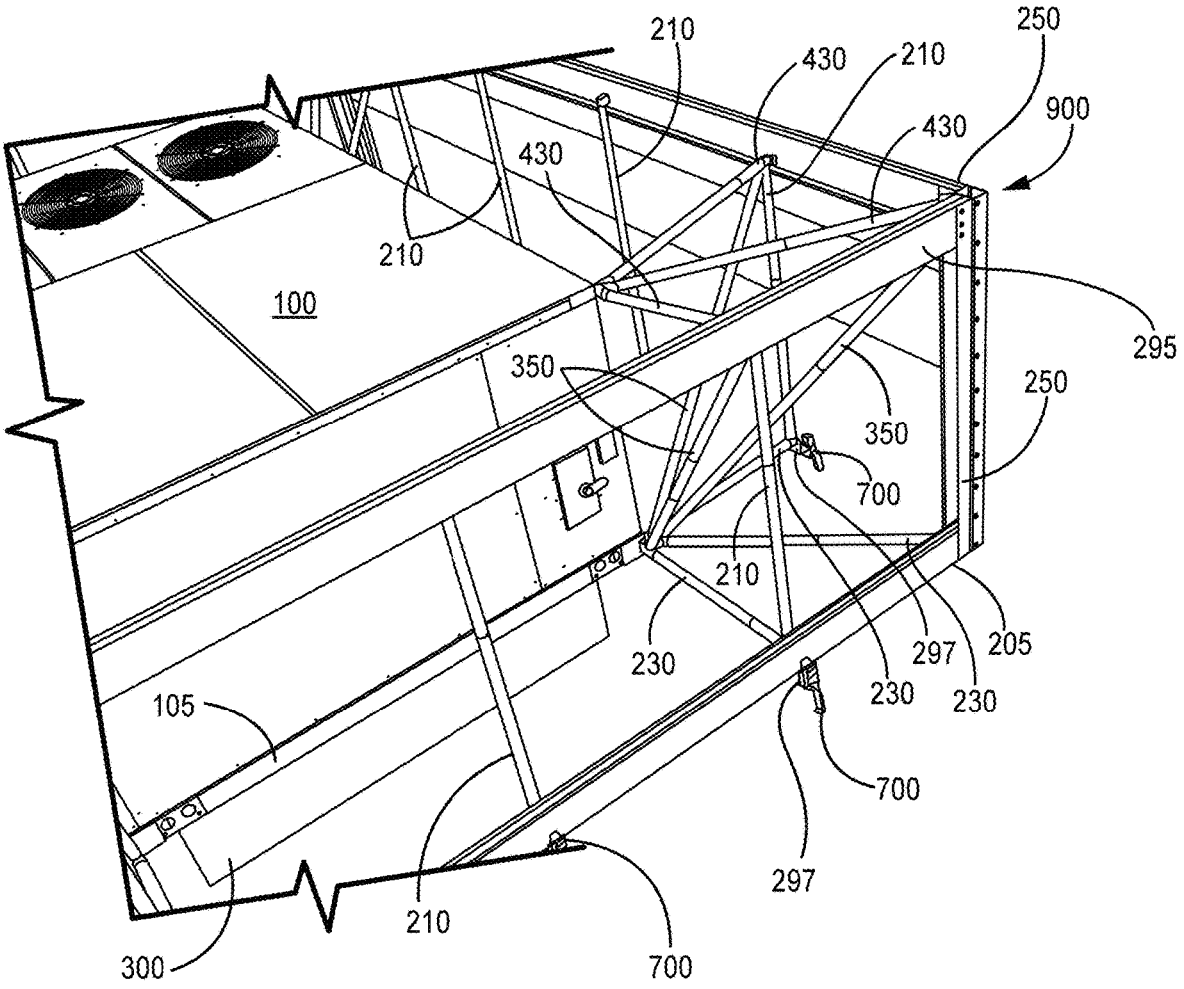
FIG. 7 is a broken-away perspective view of a first corner region of the rooftop HVAC assembly of FIG. 2, with a fabric screen of the front screen panel omitted for illustration purposes.

As illustrated, the screening system 200 has a framework that preferably is devoid of structural frame members extending over and above the HVAC equipment. This is best shown in FIGS. 2, 3, and 7. Here, no frame member or other part of the illustrated screening system 200 extends over and above the HVAC equipment. This, however, is not required. Furthermore, the screening system 200 preferably does not include a roof portion or top cover that is located on top of the side walls of the screening system and/or is positioned directly above the HVAC equipment 100. But this too is not required.

In some embodiments, the screening system 200 is configured such that, when the screen panel 275 is in the upper, open position, a base rail 205 of the screen panel is retained alongside (e.g., so as to be beneath and adjacent to) a top rail 295 of the framework, thereby creating an open doorway through which a worker can access the HVAC equipment. This can be appreciated by referring to FIGS. 6 and 14. In such cases, the open doorway preferably is bounded on a top side by the screen panel 275 and on a bottom side by the roof RF of the building. Preferably, a person can enter (e.g., walk) through the open doorway. In more detail, the open doorway preferably comprises one or more doorway regions that are entirely open from outside the screening system 200 directly to a confronting face of the HVAC equipment 100. In such cases, a person preferably can enter (e.g., walk) through each such doorway region. This is perhaps best seen in FIG. 6, which shows three such doorway regions (each between two optional vertical mount beams 210) for the illustrated open doorway.

The framework preferably is devoid of a lower horizontal frame member (or any other member or body) adjacent the roof RF of the building that could create a tripping hazard where a person enters (e.g., walks) through the open doorway. If desired, the screening system 200 can be configured such that once a person has entered through one of a plurality of doorway regions of the open doorway, they can walk along the adjacent face of the HVAC equipment 100 (e.g., along the collective span of the doorway regions) without encountering a lower horizontal frame member (or any other member or body) adjacent the roof RF of the building that could create a tripping hazard.

Thus, the screen panel 275 is adjustable between the lower, closed position and the upper, open position, preferably by sliding a base rail 205 of the screen panel along the upright track. As noted above, the screen panel 275 preferably includes a fabric screen 225 having an upper end and a lower end, with the base rail 205 attached to the lower end of the fabric screen. The screening system 200 can optionally be configured such that the base rail 205 is maintained in a generally (or substantially) horizontal orientation when sliding along the upright track. The screening system 200, for example, can advantageously include a levelling mechanism.

In certain embodiments, the screening system 200 includes a cable system (e.g., a parallel restraint cable system) configured to maintain the base rail 205 in a generally (or substantially) horizontal orientation when sliding along the upright track. When provided, the cable system includes one or more cables 850, which preferably extend inside a base rail 205 of the screen panel 275. Such one or more cables 850 can optionally include at least two vertical spans and at least two diagonal spans, preferably together with at least one horizontal span. Reference is made to the non-limiting example of FIGS. 15 and 16.

If desired, steel cable can be used. In other cases, it may be advantageous to use synthetic cable or rope instead. This may be advantageous, for example, in providing additional corrosion resistance. One suitable synthetic cable or rope material is ultra-high molecular weight polyethylene (UHMWPE). Synthetic cable/rope of this nature, sold under the trade name Dyneema, is commercially available from Avient Corporation (Avon Lake, Ohio, U.S.A.). Thus, when provided, the one or more cables 850 may be cable (e.g., cable comprising metal) or rope (e.g., rope comprising synthetic fiber). If the one or more cables 850 are rope, it is also possible to use various natural fiber ropes.

Figure 15:
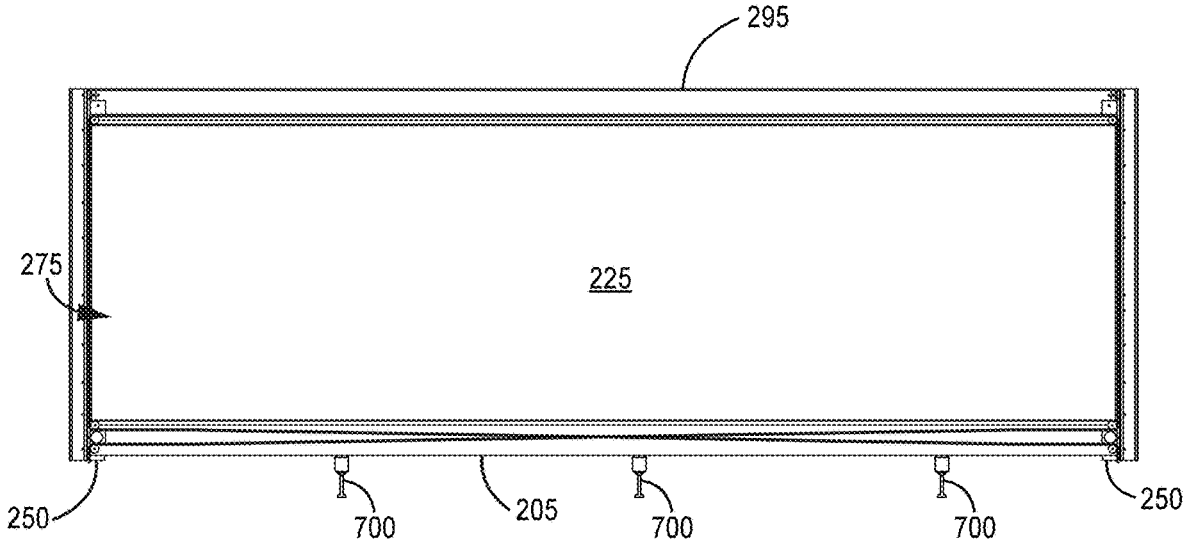
FIG. 15 is a schematic cross-sectional view of a cable and pulley system that can be used advantageously in certain embodiments of the invention.
Figure 16:
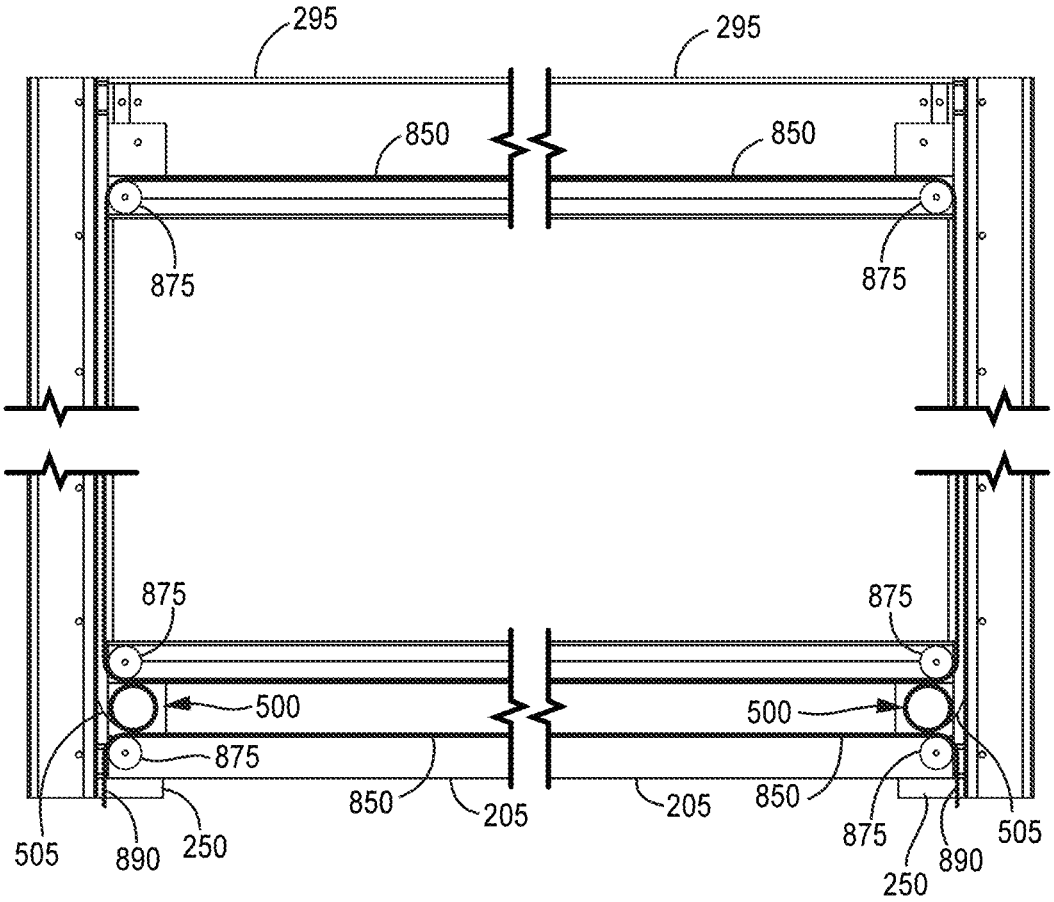
FIG. 16 is a broken-away detail view of the four corner regions of the cable and pulley system shown in FIG. 15.

When provided, the cable system preferably includes one or more pulleys 875 on which the one or more cables 850 are received. For example, the one or more pulleys 875 can optionally include two or more pulleys 875 within (e.g., housed inside) the base rail 205. This is shown in FIGS. 15 and 16. When provided, the pulleys 875 can optionally each have a diameter at least 20 times that of the cable 850 received by the pulleys. This can advantageously reduce the tendency for cables to work-harden from bending.

As noted above, the screening system 200 preferably includes a top rail 295, an upright left track member 250, and an upright right track member 250. In some preferred embodiments, upright left and right track members 250 define between them the upright track. When provided, the one or more pulleys 875 can optionally include two or more pulleys 875 within (e.g., housed inside) a top rail 295. In some cases, one or more cables 850 of the cable system extend from a top rail 295 (or other upper bar, housing, panel, and/or other upper component) to a base rail 205 of the screen panel 275. This too is shown in FIGS. 15 and 16.

The illustrated cable system is a parallel restraint cable system. Here, there is a first set of pulleys 875 (e.g., upper pulleys), which can optionally be on (e.g., within) a top rail 295 (or other upper bar, housing, panel, and/or other upper component) of the screening system 200, as well as a second set of pulleys 875 (e.g., lower pulleys), which can optionally be on (e.g., within) a base rail 205 (or other lower bar, housing, panel, and/or other lower component) of the screening system. In some cases, only a single cable 875 is received by both the first and second sets of pulleys 875. Furthermore, the cable(s) 875 preferably include two parallel, vertical spans, in addition to including two diagonal spans that cross each other (see cable arrangement in the base rail 205 of FIG. 15). FIG. 16 shows two locations 890 where two ends of the illustrated cable 875 are anchored. If desired, one or more optional springs can be attached to the cable(s) to adjust tension. It is to be appreciated that the foregoing details are by no means limiting. Various other cable systems can be used. Further, levelling systems other than cable systems can be used. Still further, the levelling system can be omitted, with the idea that operators can manually level the base rail while raising or lowering it.

Thus, the screening system 200 preferably includes one or more adjustable (i.e., selectively openable and closeable) screen panels 275. If desired, the screening system may have only one adjustable screen panel. In other embodiments, the screening system 200 includes a plurality of adjustable screen panels 275. In FIG. 1, for example, the screening system 200 is shown with three adjustable screen panels 275. In FIGS. 2-14, the screening system 200 includes four adjustable screen panels 275. Embodiments of this nature can provide ready, direct access to all sides (e.g., to four sides) of the HVAC equipment 100.

In the present disclosure, reference is sometimes made to a screen panel 275, a fabric screen 225, or another component. It is to be appreciated that, for embodiments involving multiple screen panels 275, such discussions apply to each screen panel, fabric screen 225, or other component.

As noted above, the screen panel 275 can comprise a fabric screen 225, in combination with the screening system 200 including a latch system. When provided, the latch system preferably has an unlocked configuration and a locked configuration. In such cases, the screening system 200 preferably is configured such that when the latch system is in the locked configuration, the screen panel 275 is in the lower, closed position with the latch system holding the fabric screen 225 in tension. In some cases, when the screen panel 275 is in the lower, closed position, the fabric screen 225 is held at a tension of between 15 and 45 pounds per linear inch, such as between 20 and 40 pounds per linear inch. In one non-limiting example, it is about 31.24 pounds per linear inch.

In some preferred embodiments, the latch system includes one or more (optionally a plurality of) draw latches 700. In certain embodiments of this nature, each draw latch 700 (e.g., a hook, claw, bail or other detent thereof) is releasably connectable to the screen panel 275 (e.g., to a keeper, latch plate or other hardware thereon). In some cases, each draw latch 700 is a toggle-style draw latch (e.g., a toggle latch clamp), although various types of draw latches can be used. If desired, various flexible draw latches may be used. In other cases, all-metal draw latches are used. By way of example, various over-center draw latches, either flexible or all-metal, may be suitable.

In some cases, each draw latch 700 is a pull-action latch clamp, such as the Gibralter 2,000 pound pull-action latch clamp, which has a drawing movement of 2½ inches. More generally, each draw latch 700 can optionally have a drawing movement of one inch or more, or two inches or more, such as 2-3 inches (e.g., 2½ inches).

In some embodiments, the screening system 200 includes a plurality of mount beams 210 that each support a respective one of the draw latches 700. For example, a hook, claw, bail or other detent of a draw latch 700 may be supported by (e.g., mounted on) each such mount beam 210. Or a keeper, strike plate or other similar hardware may be supported by (e.g., mounted on) each such mount beam 210. Preferably, one or more (optionally a plurality) of the mount beams 210 are vertical beams. In the embodiments illustrated, the screening system 200 comprises a framework that includes a top rail 295, and a plurality of vertical mount beams 210 each extend downwardly from the top rail 295 to a respective base mount 297. In such cases, each of the draw latches 700 can optionally be mounted on the base mount 297 of a respective one of the vertical mount beams 210. If desired, the illustrated base mounts 297 can be omitted, in favor of mounting the draw latches directly to the vertical beams and/or to horizontal beams.

If desired, one or more (e.g., a plurality of) vertical mount beams 210 extending downwardly (optionally from a top rail 295) to respective base mounts 297 can terminate at free ends. When provided, each such vertical mount beam 210 can optionally have a fixed top end and a free bottom end. For example, one or more vertical mount beams 210 can each terminate at a free bottom end (while the top end is fixed, optionally to a top rail 295), whereas one or more other vertical mount beams 210 each terminate at a bottom end that is structurally joined to a horizontal support beam 230. Again, if desired, the illustrated base mounts 297 can be omitted, in favor of mounting the draw latches directly to the vertical beams and/or horizontal beams.

Figure 4:
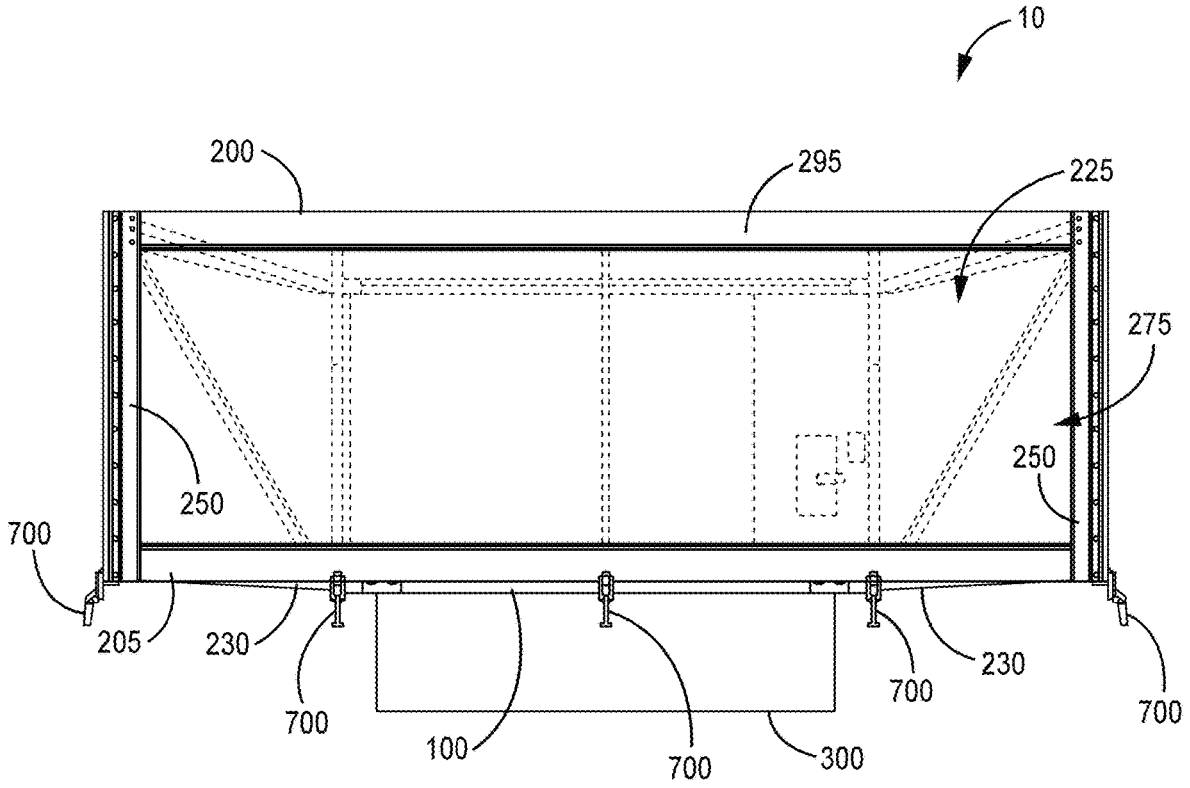
FIG. 4 is a side view of the rooftop HVAC assembly of FIG. 2.

In FIG. 4, the illustrated adjustable screen panel 275 is operably coupled with one vertical mount beam 210 that terminates at a free bottom end (while the top end is fixed to a top rail 295), whereas two other vertical mount beams 210 each terminate at a bottom end that is structurally joined to a respective horizontal support beam 230. Note that FIG. 4 shows an adjustable screen panel 275 that is alongside a width of the HVAC equipment 100.

Figure 5:
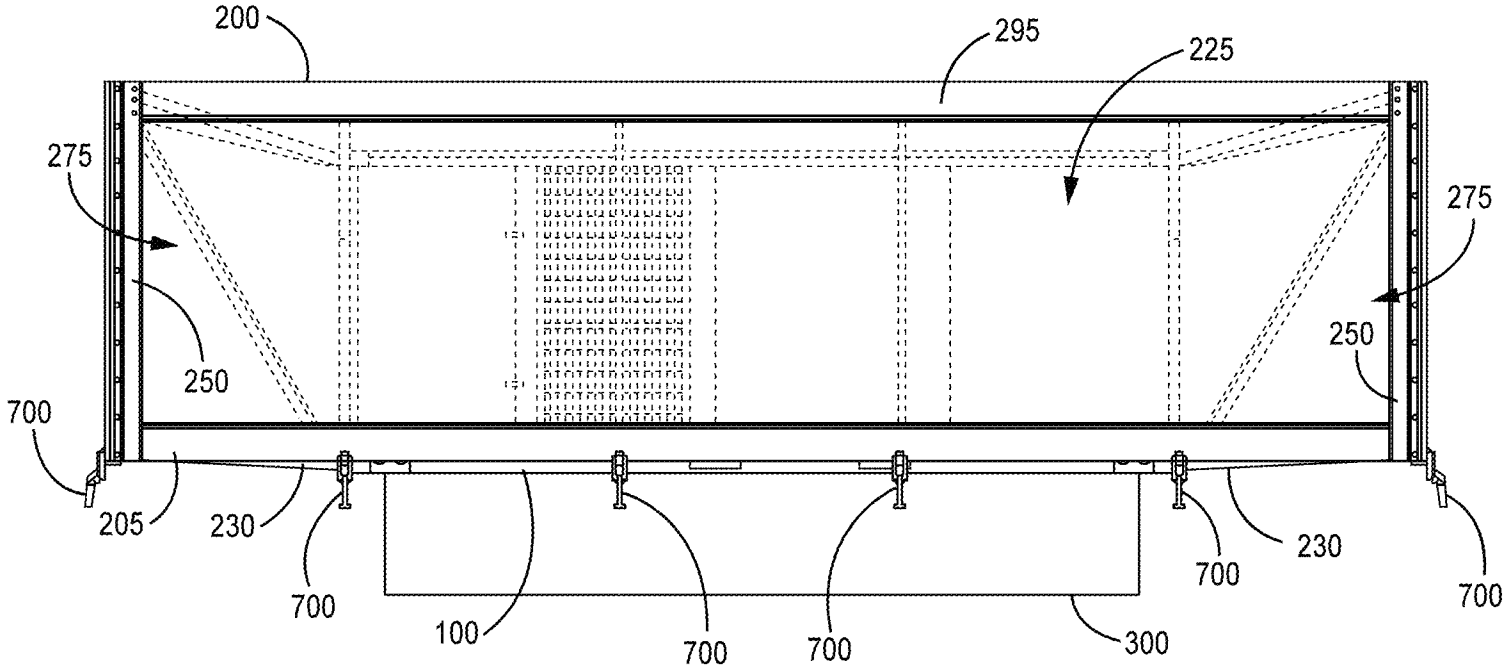
FIG. 5 is a front view of the rooftop HVAC assembly of FIG. 2, with a front screen panel shown in a closed position.
Figure 6:
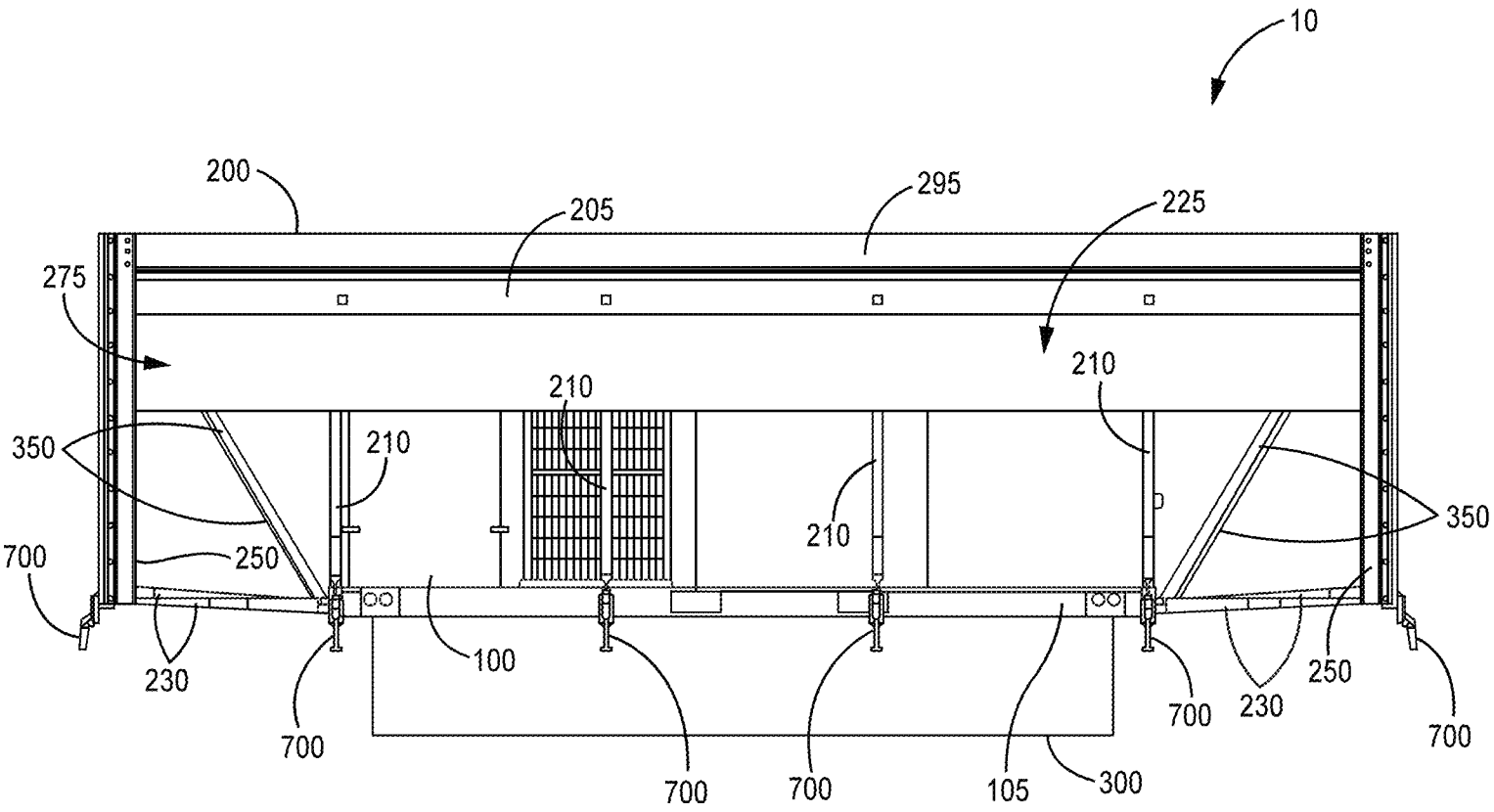
FIG. 6 is a front view of the rooftop HVAC assembly of FIG. 2, with the front screen panel shown in an open position.

In FIGS. 5 and 6, the illustrated adjustable screen panel 275 is operably coupled with two vertical mount beams 210 that each terminate at a free bottom end (while the top end is fixed to a top rail 295), whereas two other vertical mount beams 210 each terminate at a bottom end that is structurally joined to a respective horizontal support beam 230. Note that FIGS. 5 and 6 show an adjustable screen panel 275 that is alongside a length of the HVAC equipment 100.

It is to be appreciated that the foregoing examples are by no means limiting in terms of the number of vertical mount beams 210 that may be operably coupled with a given screen panel 275. When such vertical mount beams are provided, there may simply be one operably coupled with a screen panel, or there may be more than four vertical mount beams operably coupled with a screen panel. The number and arrangement of such vertical mount beams may be selected, for example, based on the size and shape of the HVAC equipment.

In embodiments with multiple vertical mount beams 210, one or more of the vertical mount beams can each be a doorway mullion, which bounds two doorway openings on opposites left and right sides thereof. For the open doorway shown in FIG. 6, for example, there are two such vertical mount beams 210. This, however, is by no means required.

As noted above, the fabric screen 225 can have an upper end and a lower end, and the screen panel 275 can comprise a base rail 205 attached to the lower end of the fabric screen. In some embodiments of this nature, the screening system 200 is provided with a latch system that includes a plurality of draw latches 700, each coupled with a latch plate or other keeper on the base rail 205, such that there are a plurality of latch plates or other keepers on the base rail. This is perhaps best seen in FIGS. 6 and 14.

The screening system 200 can optionally include one or more spring mechanisms 500 configured to reduce the effort required for a worker to adjust (e.g., move) a screen panel 275 from the lower, closed position to the upper, open position. In some embodiments, such one or more spring mechanisms 500 can be configured to reduce the effort required for a worker to lift (e.g., slide) a base rail 205 of the screen panel 275 upwardly, so as to adjust the screen panel from the lower, closed position to the upper, open position. When provided, the one or more spring mechanisms 500 comprise one or more (preferably two) springs 505 operably coupled with the screen panel 275. Each spring 505 can be a pretensioned spring.

Referring to FIG. 16, it can be appreciated that each adjustable screen panel 275 can optionally be equipped with one or more spring mechanisms 500. In the non-limiting example of FIG. 16, the illustrated screen panel 275 is equipped with two spring mechanisms 500, one on a left side of the screen panel, the other on a right side of the screen panel. Here, each illustrated spring 505 extends from the base rail 205 to the top rail 295. In this non-limiting example, each spring 505 is a pretensioned spring, which is received by a drum mounted on (e.g., inside) the base rail 205. In other cases, a drum carrying the spring can instead be mounted on (e.g., inside) a top rail. Furthermore, given the present teaching as a guide, various other alternatives will be apparent to a person of ordinary skill in this field.

When provided, each spring 505 can optionally be a constant-force spring. Suitable constant-force springs are commercially available from various commercial suppliers, including the McMaster-Carr Supply Company (Elmhurst, Illinois, U.S.A.), such as the constant-force spring sold under part number 9293K58.

Preferably, the screening system 200 is devoid of footings resting on the roof RF of the building. This is shown in FIG. 1, and can also be appreciated by referring to FIGS. 13 and 14. Thus, the illustrated screening system 200 preferably does not contact the roof RF of the building.

The HVAC equipment 100 can advantageously be mounted operably on the roof RF of the building by a support 300, such as a roof curb or set of equipment rails. For example, the illustrated HVAC equipment 100 preferably is mounted operably on the roof RF of the building by a support 300 that is a roof curb or set of equipment rails, but the screening system preferably is not attached to (and preferably does not contact) the roof curb or set of equipment rails.

The screening system 200 can offer advantages in terms of withstanding challenging weather conditions, such as thunderstorm winds or even hurricane force winds. As one example, the screening system 200 preferably is configured to withstand thunderstorm winds as high as 105 miles per hour, per UBC (Uniform Building Code) standards. Moreover, the screening system 200 can optionally have adjustable screen panels 275 on all sides. In such cases, in the event of extremely high winds (e.g., hurricane force winds), it is possible to open all the screen panels 275 so as to reduce the extent to which the screening system 200 catches the wind.

In a second group of embodiments, the invention provides a screening system 200 for a rooftop HVAC assembly 10 comprising HVAC equipment 100 and the screening system 200. In the present embodiments, the screening system 200 is configured to be operatively assembled so as to surround the HVAC equipment 100 when mounted operably on a roof RF of a building. The screening system 200 includes a screen panel 275. In more detail, the screening system 200 is configured to be operatively assembled such that the screen panel 275 is adjustable between a lower, closed position and an upper, open position by moving at least part of the screen panel (e.g., a base rail 205 thereof) selectively upwardly or downwardly, optionally along the upright track. Thus, in some embodiments, the screening system 200 includes (e.g., defines) an upright track. The screening system 200 of the present embodiment group can be of the same nature described above for the first group of embodiments, but in the present embodiments the screening system 200 is required to be neither provided together with the HVAC equipment 100 nor mounted operably on a roof RF of a building. For example, the screening system 200 can be provided in the form of a kit (or a staged grouping or other collection of components) that includes the screening system components noted herein and that, when operatively assembled, surrounds the HVAC equipment 100, as noted above.

In embodiments of this nature, the screening system 200 preferably is configured to be operatively assembled such that the screen panel 275 is adjustable, without any disassembly of the screening system, between the lower, closed position and the upper, open position.

Preferably, the screening system 200 is configured to be operatively assembled such that the screen panel 275 has an uppermost extent that is at the same elevation whether the screen panel is in the lower, closed position or the upper, open position. Additionally or alternatively, the screening system 200 can optionally be configured to be operatively assembled such that a top rail 295 of the framework is at the same elevation whether the screen panel 275 is in the lower, closed position or the upper, open position.

In preferred embodiments, the screen panel 275 comprises a fabric screen 225. In such embodiments, the screening system 200 can optionally be configured to be operatively assembled such that the fabric screen 225 is retained in a taut position when the screen panel 275 is in the lower, closed position. Additionally or alternatively, the screening system 200 can optionally be configured to be operatively assembled such that the fabric screen 225 is folded over itself when the screen panel 275 is in the upper, open position.

When provided, the fabric screen 225 has an upper end and a lower end, and the screen panel 275 preferably further includes a base rail 205 attached to the lower end of the fabric screen. In such cases, the screening system 200 preferably is configured to be operatively assembled such that the screen panel 275 is adjustable between the lower, closed position and the upper, open position by moving the base rail 205 selectively upwardly or downwardly, such as by sliding the base rail 205 along an upright track. As noted above, the screening system 200 may include a framework comprising a top rail 295, and the upper end of the fabric screen 225 can optionally be attached to the top rail of the framework. In embodiments of this nature, the screening system 200 preferably is configured to be operatively assembled such that, when the screen panel 225 is in the upper, open position, the base rail 205 of the screen panel is retained alongside the top rail 295 of the framework, thereby creating an open doorway through which a worker can access the HVAC equipment 100. In more detail, the screening system 200 preferably is configured to be operatively assembled such that the open doorway is bounded on a top side by the screen panel 275 and on a bottom side by the roof RF of the building, e.g., such that the framework is devoid of a lower horizontal frame member adjacent the roof of the building that could create a tripping hazard at the open doorway.

Thus, the screening system 200 is configured to be operatively assembled such that the screen panel 275 is adjustable between the lower, closed position and the upper, open position, preferably by sliding a base rail 205 of the screen panel along an upright track while staying in a generally (or substantially) horizontal orientation. To this end, the screening system 200 can optionally include a cable system configured to maintain the screen panel 275 in a generally (or substantially) horizontal orientation when sliding along the upright track. When provided, the cable system can include one or more cables and one or more pulleys, as described previously. Furthermore, the screening system 200 preferably comprises a framework that includes a top rail 295, and when the screening system is operatively assembled, one or more cables of the cable system can optionally extend from the top rail of the framework to a base rail 205 of the screen panel 275.

As noted above, the screen panel 275 preferably comprises a fabric screen 225, and the screening system 200 can optionally include a latch system. In such embodiments, the screening system 200 preferably is configured to be operatively assembled such that: (i) the latch system has an unlocked configuration and a locked configuration, and (ii) when the latch system is in the locked configuration, the screen panel 275 is in the lower, closed position with the latch system holding the fabric screen 225 in tension.

When provided, the latch system can optionally include a plurality of draw latches 700, each releasably connectable to the screen panel 275. Furthermore, the screening system 200 can comprise a framework, which preferably includes a top rail 295 and may also include a plurality of vertical beams 210 that each extend downwardly from the top rail 295 to a base mount 297 (when the screening system 200 is operatively assembled). In such cases, the plurality of draw latches 700 preferably are each mounted on the base mount 297 of a respective one of the vertical beams 210.

In some cases, a first group of vertical beams 210 extending downwardly from a top rail 295 to respective base mounts 297 (when the screening system 200 is operatively assembled) terminate at free ends. In some such cases, a second group of vertical beams 210 extending downwardly from the top rail 295 to the respective base mounts 297 (when the screening system 200 is operatively assembled) terminate at ends that are each structurally joined to a horizontal support beam 230.

Further, when the screening system 200 includes a plurality of draw latches 700, they may each be a toggle-type draw latches. In such cases, each draw latch can optionally include a latch plate or other keeper on the base rail 205 such that there are a plurality of latch plates or other keepers on the base rail.

In the second embodiment group, the screening system 200 preferably comprises a framework that is devoid of structural frame members that extend over and above the HVAC equipment 100 when the screening system is operatively assembled.

Preferably, the screening system 200 does not contact the roof RF of the building when the screening system is operatively assembled. For example, the screening system 200 can be devoid of footings that rest on the roof RF of the building when the screening system is operatively assembled. Additionally or alternatively, the HVAC equipment 100 preferably is configured to rest on a support 300, which is a roof curb or set of equipment rails, when mounted operably on the roof RF of the building, and the screening system can optionally be configured such that it is not attached to the roof curb or set of equipment rails when the screening system 200 is operatively assembled.

In a third group of embodiments, the invention provides a rooftop HVAC assembly 10 comprising HVAC equipment 100 and a screening system 200. In this embodiment group, the HVAC equipment 100 is mounted operably on a roof RF of a building, and the screening system 200 is assembled operatively so as to surround the HVAC equipment. In the present embodiments, the HVAC equipment 100 has a length and a width, and the screening system 200 includes two length walls and two width walls. The two length walls extend alongside the length of the HVAC equipment 100, and the two width walls extend alongside the width of the HVAC equipment. In the present embodiments, the screening system 200 includes a plurality of adjustable-length beams. Preferably, the screening system includes: (i) one or more adjustable-length beams extending from the HVAC equipment to a first of the two length walls, and (ii) one or more adjustable-length beams extending from the HVAC equipment to a first of the two width walls.

Preferably, the adjustable-length beams each comprise tubes configured to telescope to provide length adjustability. Such tubes can optionally have a circular cross section. This is perhaps best appreciated by referring to FIG. 7 in view of FIG. 3. In the embodiment illustrated, the adjustable length beams include a plurality of lower support beams 230, a plurality of diagonal support beams 350, and a plurality of upper support beams 430.

Preferably, all of the adjustable-length beams of the screening system 200 are positioned within substantially the same elevation range as the HVAC equipment 100. For example, there preferably are no adjustable-length beams extending over and above the HVAC equipment 100.

When provided, the one or more adjustable-length beams extending from the HVAC equipment 100 to the first of the two length walls preferably comprise at least one diagonal adjustable-length beam 350, which extends diagonally from the HVAC equipment 100 to the first of the two length walls. Furthermore, when provided, the one or more adjustable-length beams extending from the HVAC equipment 100 to a first of the two width walls preferably comprise at least one diagonal adjustable-length beam 350, which extends diagonally from the HVAC equipment to the first of the two width walls.

In certain embodiments of the present group, one or more adjustable-length beams extending from the HVAC equipment 100 to the first of the two length walls comprise: (a) an upper adjustable-length beam 430 extending from the HVAC equipment to the first of the two length walls, and (b) a lower adjustable-length beam 230 extending from the HVAC equipment to the first of the two length walls. In embodiments of this nature, the upper adjustable-length beam 430 is at a higher elevation than the lower adjustable-length beam 230. Furthermore, one or more adjustable-length beams extending from the HVAC equipment 100 to the first of the two width walls can optionally comprise: (a) an upper adjustable-length beam 430 extending from the HVAC equipment to the first of the two width walls, and (b) a lower adjustable-length beam 230 extending from the HVAC equipment to the first of the two width walls.

Figure 8:
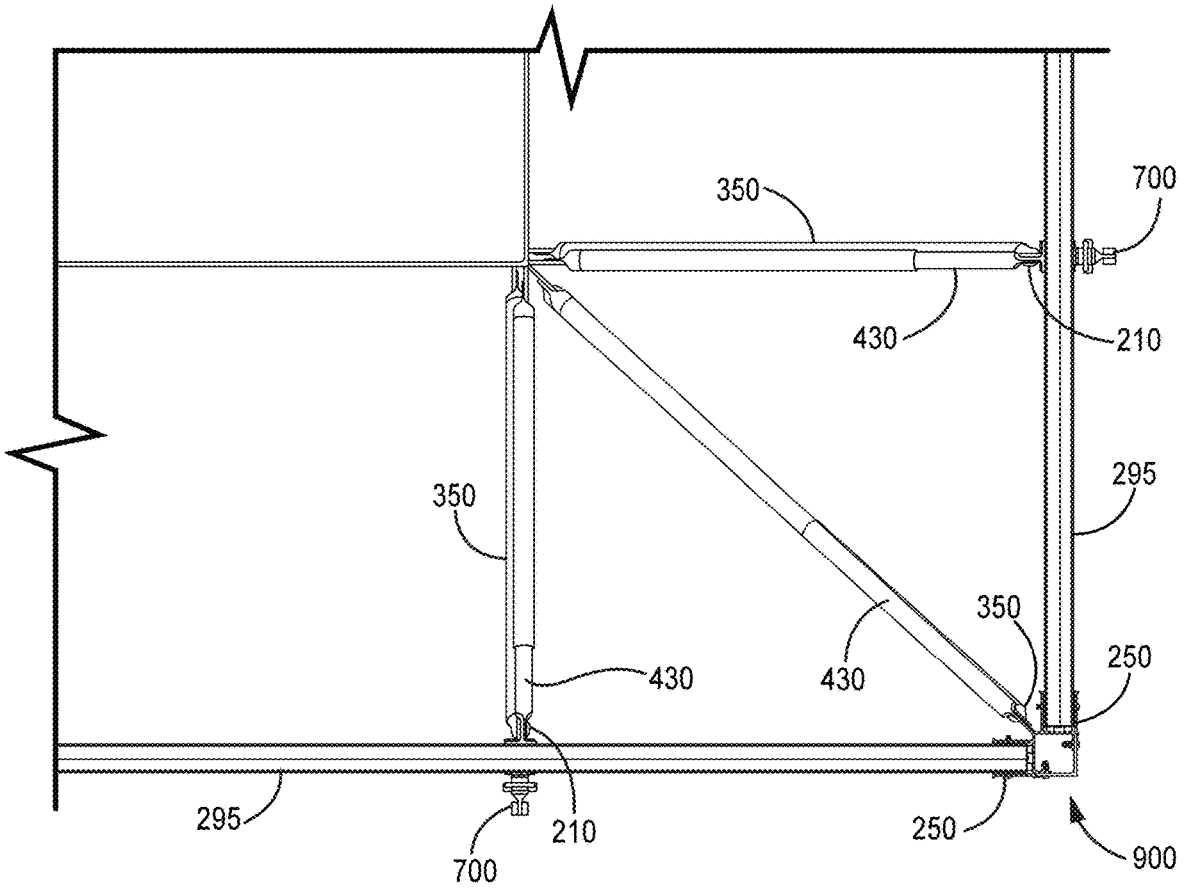
FIG. 8 is a broken-away plan view of the first corner region of FIG. 7.
Figure 9:
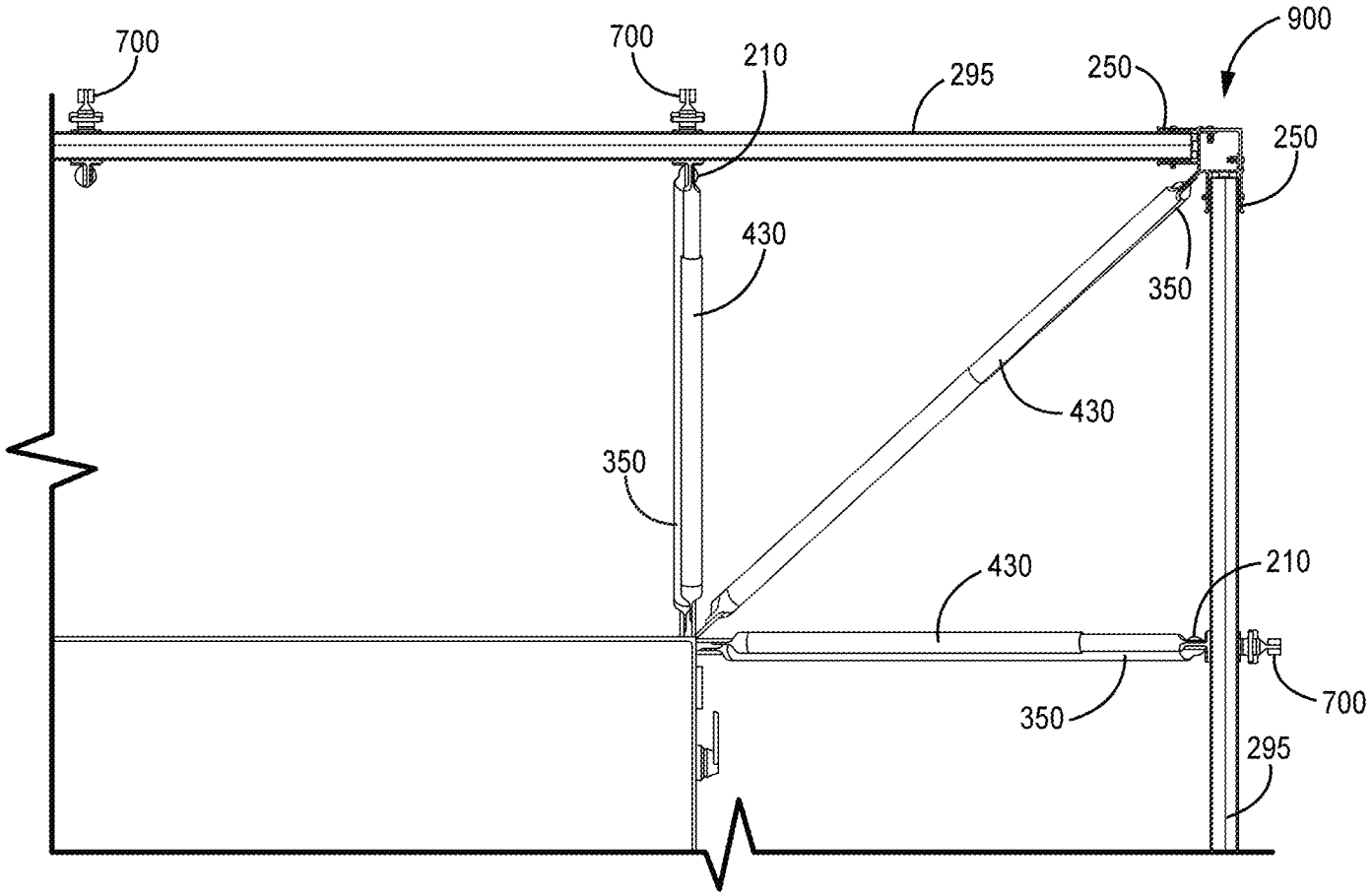
FIG. 9 is a broken-away plan view of a second corner region of the rooftop HVAC assembly of FIG. 2.
Figure 10:
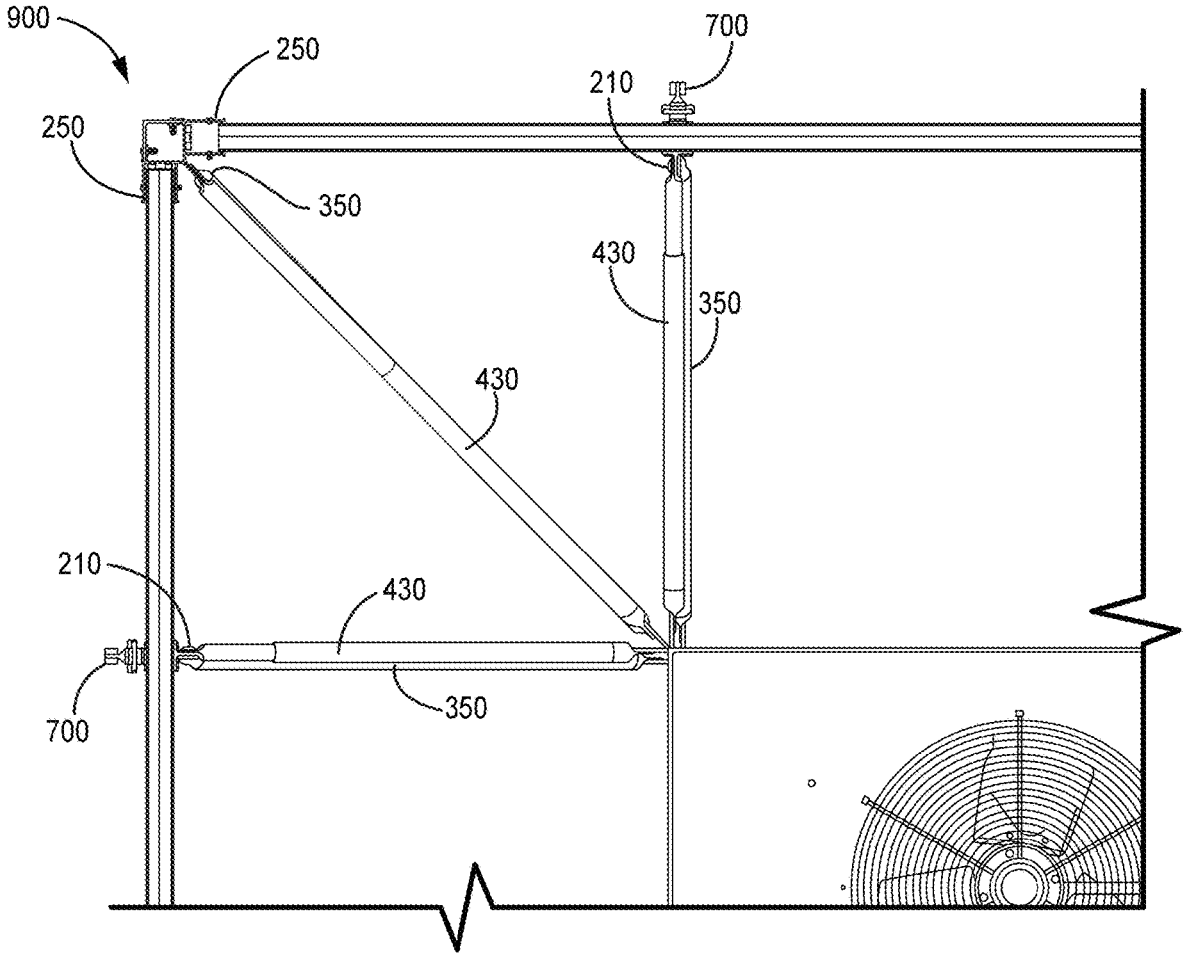
FIG. 10 is a broken-away plan view of a third corner region of the rooftop HVAC assembly of FIG. 2.
Figure 11:
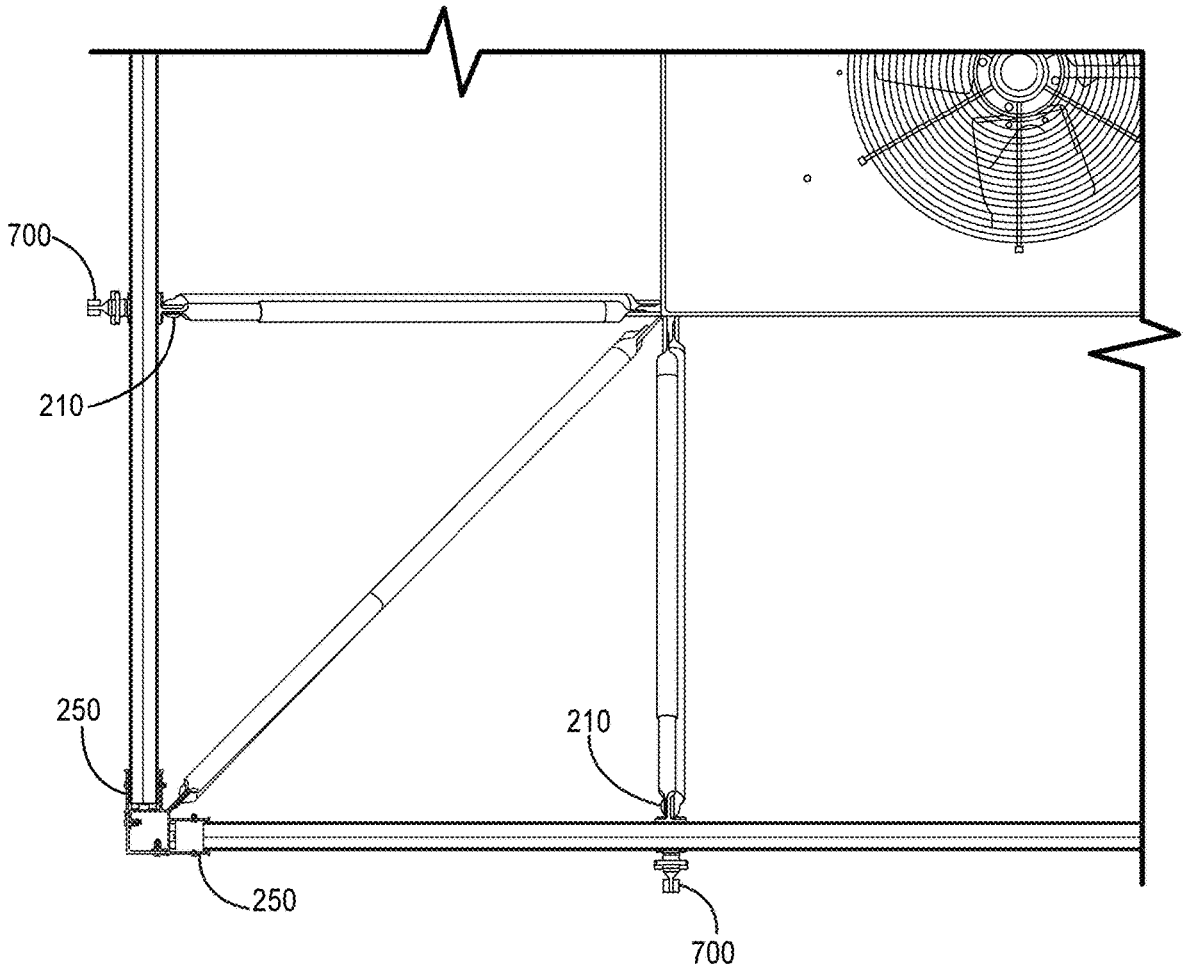
FIG. 11 is a broken-away plan view of a fourth corner region of the rooftop HVAC assembly of FIG. 2.

The screening system 200 can optionally include at least one adjustable-length beam extending from the HVAC equipment 100 to a corner. In more detail, this corner is an internal corner of the screening system at an intersection of the first of the two length walls and the first of the two width walls. Reference is made to FIG. 8. For example, the screening system 200 preferably includes at least one diagonal adjustable-length beam 350 that extends diagonally from the HVAC equipment 100 to the corner.

Additionally or alternatively, the screening system 200 can optionally include: (a) an upper adjustable-length beam 430 extending from the HVAC equipment 100 to the corner, and (b) a lower adjustable-length beam 230 extending from the HVAC equipment 100 to the corner. Reference is made to FIG. 7. In such cases, the upper adjustable-length beam 430 is at a higher elevation than the lower adjustable-length beam 230.

In certain embodiments of the present group, the HVAC equipment 100 has a generally rectangular configuration and includes four corner regions. In such embodiments, the screening system 200 preferably includes four mount assemblies attached respectively to the four corner regions of the HVAC equipment 100. Reference is made to FIGS. 1-2 and 14-15 in view of FIG. 7. Here, the illustrated screening system 200 only has mount assemblies (e.g., only has support beams extending outwardly from the HVAC equipment to support the walls of the screening system) at the corner regions. This can optionally be the case for any embodiment of the present disclosure. In such cases, once a worker has entered an open doorway (e.g., through a doorway region) of the screening system 200, they can move freely sideways along the adjacent face of the HVAC equipment 100 until reaching either adjacent corner region, where there is a mount assembly.

Furthermore, each of four such corner regions of the HVAC equipment 100 preferably includes a top corner area and a bottom corner area. In such cases, at each corner region of the HVAC equipment 100, one of the four mount assemblies preferably comprises a first plurality of adjustable-length beams anchored to the bottom corner area and a second plurality of adjustable-length beams anchored to the top corner area. Here again, reference is made to FIGS. 1-2 and 14-15 in view of FIG. 7. The first plurality of adjustable-length beams can optionally include at least one diagonal adjustable-length beam 350 (e.g., three such beams). Additionally or alternatively, the first plurality of adjustable-length beams preferably includes at least one horizontal adjustable-length beam (e.g., three such beams). In addition, the second plurality of adjustable-length beams preferably includes at least one horizontal adjustable-length beam 230 (e.g., three such beams).

In the present embodiment group, the rest of the structure and functionality of the screening system 200 preferably is of the nature described above relative to the first two embodiment groups. It is to be appreciated, however, that the present adjustable support beam system can be used advantageously with many other types of screening systems, including those with panels or doors of different constructions, as well as various systems where the walls do not have openable panels or doors.

The screening system can offer a lightweight design. For example, it can be constructed from components that, in many cases, can be brought to the rooftop in an elevator of the building's using only manual labor. This can be advantageous, for example, from a maintenance standpoint.

Various examples have been described. These and other examples are within the scope of the following claims.

The invention claimed is:

1. A rooftop HVAC assembly comprising HVAC equipment and a screening system, the HVAC equipment being mounted operably on a roof of a building by a support that is a roof curb or set of equipment rails, wherein the screening system does not contact the roof of the building and is not attached to the roof curb or set of equipment rails but rather is attached to the HVAC equipment, the screening system being assembled operatively so as to surround the HVAC equipment, the screening system including a screen panel that is adjustable between a lower, closed position and an upper, open position by moving at least part of the screen panel selectively upwardly or downwardly, and the screen panel comprises a fabric screen formed of an opaque fabric that is substantially impervious to wind.

2. The rooftop HVAC assembly of claim 1 wherein the screen panel has an uppermost extent that is at the same elevation whether the screen panel is in the lower, closed position or the upper, open position.

3. The rooftop HVAC assembly of claim 1 wherein the screen panel is adjustable, without any disassembly of the screening system, between the lower, closed position and the upper, open position.

4. The rooftop HVAC assembly of claim 1 wherein the screening system is configured such that the fabric screen is retained in a taut position when the screen panel is in the lower, closed position, and the screening system is configured such that the fabric screen is folded over itself when the screen panel is in the upper, open position.

5. A rooftop HVAC assembly comprising HVAC equipment and a screening system, the HVAC equipment being mounted operably on a roof of a building by a support that is a roof curb or set of equipment rails, wherein the screening system does not contact the roof of the building and is not attached to the roof curb or set of equipment rails but rather is attached to the HVAC equipment, the screening system being assembled operatively so as to surround the HVAC equipment, the screening system including a screen panel that is adjustable between a lower, closed position and an upper, open position by moving at least part of the screen panel selectively upwardly or downwardly, wherein the screen panel comprises a fabric screen, the fabric screen has an upper end and a lower end, and the screen panel further comprises a base rail attached to the lower end of the fabric screen, the screen panel is adjustable between the lower, closed position and the upper, open position by sliding the base rail of the screen panel along an upright track, the screening system comprises a framework that includes a top rail, an upright left track member, and an upright right track member, the upright left and right track members defining between them the upright track, and the screening system is configured such that, when the screen panel is in the upper, open position, the base rail of the screen panel is retained alongside the top rail of the framework, thereby creating an open doorway through which a worker can access the HVAC equipment, and wherein the open doorway is bounded on a top side by the screen panel, on a left side by the upright left track member, on a right side by the upright right track member, and on a bottom side by the roof of the building, such that the framework is devoid of a lower horizontal frame member adjacent the roof of the building that could create a tripping hazard at the open doorway.

6. A rooftop HVAC assembly comprising HVAC equipment and a screening system, the HVAC equipment being mounted operably on a roof of a building, the screening system being assembled operatively so as to surround the HVAC equipment, the screening system including a screen panel that is adjustable between a lower, closed position and an upper, open position by moving at least part of the screen panel selectively upwardly or downwardly, wherein the screen panel comprises a fabric screen, the fabric screen has an upper end and a lower end, and the screen panel further comprises a base rail attached to the lower end of the fabric screen, the screen panel is adjustable between the lower, closed position and the upper, open position by sliding the base rail of the screen panel along an upright track, the screening system comprises a framework that includes a top rail, an upright left track member, and an upright right track member, the upright left and right track members defining between them the upright track, the upper end of the fabric screen is attached to the top rail of the framework, and the screening system is configured such that, when the screen panel is in the upper, open position, the base rail of the screen panel is retained alongside the top rail of the framework, thereby creating an open doorway through which a worker can access the HVAC equipment, and wherein the screen panel is adjustable between the lower, closed position and the upper, open position by sliding the base rail of the screen panel along the upright track, the screening system is configured such that the base rail of the screen panel is maintained in a generally horizontal orientation when sliding along the upright track, the screening system including a cable system configured to maintain the base rail in the generally horizontal orientation when sliding along the upright track.

7. The rooftop HVAC assembly of claim 6 wherein the cable system includes one or more cables that extend inside the base rail, and the cable system includes one or more pulleys on which the one or more cables are received.

8. The rooftop HVAC assembly of claim 1 wherein the screening system further includes a latch system, the latch system having an unlocked configuration and a locked configuration, the screening system configured such that when the latch system is in the locked configuration the screen panel is in the lower, closed position with the latch system holding the fabric screen in tension, such that when the screen panel is in the lower, closed position the fabric screen is held at tension of between 15 and 45 pounds per linear inch.

9. A rooftop HVAC assembly comprising HVAC equipment and a screening system, the HVAC equipment being mounted operably on a roof of a building, the screening system being assembled operatively so as to surround the HVAC equipment, the screening system including a screen panel that is adjustable between a lower, closed position and an upper, open position by moving at least part of the screen panel selectively upwardly or downwardly, wherein the screen panel comprises a fabric screen, and the screening system further includes a latch system, the latch system having an unlocked configuration and a locked configuration, the screening system configured such that when the latch system is in the locked configuration the screen panel is in the lower, closed position with the latch system holding the fabric screen in tension, wherein the latch system includes a plurality of draw latches, each releasably connectable to the screen panel, the screening system comprising a framework that includes a top rail and a plurality of vertical beams that each extend downwardly from the top rail to a base mount, the plurality of draw latches each being mounted on the base mount of a respective one of the vertical beams, wherein a first group of the vertical beams that extend downwardly from the top rail to the respective base mounts terminate at free ends.

10. A rooftop HVAC assembly comprising HVAC equipment and a screening system, the HVAC equipment being mounted operably on a roof of a building, the screening system being assembled operatively so as to surround the HVAC equipment, the screening system including a screen panel that is adjustable between a lower, closed position and an upper, open position by moving at least part of the screen panel selectively upwardly or downwardly, wherein the HVAC equipment has a generally rectangular configuration and includes four corner regions, the screening system further including four mount assemblies attached respectively to the four corner regions of the HVAC equipment, wherein each of the four corner regions of the HVAC equipment includes a top corner area and a bottom corner area, wherein at each of the four corner regions of the HVAC equipment one of the four mount assemblies comprises a first plurality of beams anchored to the bottom corner area and a second plurality of beams anchored to the top corner area, and wherein one or more of the first plurality of beams are adjustable in length, and one or more of the second plurality of beams are adjustable in length.

11. The rooftop HVAC assembly of claim 10 wherein the screening system comprises a framework that is devoid of structural frame members extending over and above the HVAC equipment.

12. The rooftop HVAC assembly of claim 10 wherein the screening system does not contact the roof of the building, the HVAC equipment is mounted operably on the roof of the building by a support that is a roof curb or set of equipment rails, but the screening system is not attached to the roof curb or set of equipment rails.

13. A rooftop HVAC assembly comprising HVAC equipment and a screening system, the HVAC equipment being mounted operably on a roof of a building, the screening system being assembled operatively so as to surround the HVAC equipment, the screening system including a screen panel that is adjustable between a lower, closed position and an upper, open position by moving at least part of the screen panel selectively upwardly or downwardly, wherein the screening system includes one or more spring mechanisms configured to reduce an effort required for a worker to adjust the screen panel from the lower, closed position to the upper, open position.

14. The rooftop HVAC assembly of claim 13 wherein the one or more spring mechanisms comprise two pretensioned springs operably coupled with the screen panel, wherein the screen panel comprises a fabric screen and a base rail attached to the fabric screen, the screening system comprises a framework that includes a top rail, and each of the two pretensioned springs extends from the base rail to the top rail.

15. A screening system for a rooftop HVAC assembly comprising HVAC equipment and the screening system, the screening system configured to be operatively assembled so as to surround the HVAC equipment when mounted operably on a roof of a building, the screening system including a screen panel and an upright track, the screening system configured to be operatively assembled such that the screen panel is adjustable between a lower, closed position and an upper, open position by moving at least part of the screen panel selectively upwardly or downwardly, the screen panel comprising a fabric screen formed of an opaque fabric that is substantially impervious to wind, and wherein, when the screening system is operatively assembled, it is devoid of footings that rest on the roof of the building and the HVAC equipment is mounted operably on the roof of the building by a support that is a roof curb or set of equipment rails, such that the screening system when operatively assembled is not attached to the roof curb or set of equipment rails but rather is attached to the HVAC equipment.

16. The screening system of claim 15 wherein the screening system is configured to be operatively assembled such that the screen panel has an uppermost extent that is at the same elevation whether the screen panel is in the lower, closed position or the upper, open position.

17. The screening system of claim 15 wherein the screening system is configured to be operatively assembled such that the screen panel is adjustable, without any disassembly of the screening system, between the lower, closed position and the upper, open position.

18. The screening system of claim 15 wherein the screening system is configured to be operatively assembled such that the fabric screen is retained in a taut position when the screen panel is in the lower, closed position, and the screening system is configured to be operatively assembled such that the fabric screen is folded over itself when the screen panel is in the upper, open position.

19. The screening system of claim 15 wherein the fabric screen has an upper end and a lower end, the screen panel further comprises a base rail attached to the lower end of the fabric screen, the screening system comprises a framework that includes a top rail, the upper end of the fabric screen is attached to the top rail of the framework, and the screening system is configured to be operatively assembled such that, when the screen panel is in the upper, open position, the base rail of the screen panel is retained alongside the top rail of the framework, thereby creating an open doorway through which a worker can access the HVAC equipment.

20. The screening system of claim 19 wherein the screening system is configured to be operatively assembled such that the open doorway is bounded on a top side by the screen panel and on a bottom side by the roof of the building, such that the framework is devoid of a lower horizontal frame member adjacent the roof of the building that could create a tripping hazard at the open doorway.

21. A screening system for a rooftop HVAC assembly comprising HVAC equipment and the screening system, the screening system configured to be operatively assembled so as to surround the HVAC equipment when mounted operably on a roof of a building, the screening system including a screen panel and an upright track, the screening system configured to be operatively assembled such that the screen panel is adjustable between a lower, closed position and an upper, open position by moving at least part of the screen panel selectively upwardly or downwardly, wherein the screen panel comprises a fabric screen that has an upper end and a lower end, and the screen panel further comprises a base rail attached to the lower end of the fabric screen, and the screening system is configured to be operatively assembled such that screen panel is adjustable between the lower, closed position and the upper, open position by sliding the base rail of the screen panel along an upright track while staying in a generally horizontal orientation when sliding along the upright track, the screening system including a cable system configured to maintain the screen panel in the generally horizontal orientation when sliding along the upright track.

22. The screening system of claim 21 wherein the cable system includes one or more cables that extend inside the base rail of the screen panel, and the cable system includes one or more pulleys on which the one or more cables are received.

23. A screening system for a rooftop HVAC assembly comprising HVAC equipment and the screening system, the screening system configured to be operatively assembled so as to surround the HVAC equipment when mounted operably on a roof of a building, the screening system including a screen panel and an upright track, the screening system configured to be operatively assembled such that the screen panel is adjustable between a lower, closed position and an upper, open position by moving at least part of the screen panel selectively upwardly or downwardly, wherein the screen panel comprises a fabric screen, and the screening system further includes a latch system, the screening system configured to be operatively assembled such that such that: (i) the latch system has an unlocked configuration and a locked configuration, and (ii) when the latch system is in the locked configuration the screen panel is in the lower, closed position with the latch system holding the fabric screen in tension.

24. The screening system of claim 23 wherein the latch system includes a plurality of draw latches, each releasably connectable to the screen panel, wherein the screening system comprises a framework that includes a top rail and a plurality of vertical beams that each extend downwardly from the top rail to a base mount when the screening system is operatively assembled, the plurality of draw latches each being mounted on the base mount of a respective one of the vertical beams, wherein a first group of the vertical beams that extend downwardly from the top rail to the respective base mounts when the screening system is operatively assembled terminate at free ends.

25. The screening system of claim 15 wherein the screening system comprises a framework devoid of structural frame members that extend over and above the HVAC equipment when the screening system is operatively assembled.

26. A screening system for a rooftop HVAC assembly comprising HVAC equipment and the screening system, the screening system configured to be operatively assembled so as to surround the HVAC equipment when mounted operably on a roof of a building, the screening system including a screen panel and an upright track, the screening system configured to be operatively assembled such that the screen panel is adjustable between a lower, closed position and an upper, open position by moving at least part of the screen panel selectively upwardly or downwardly, wherein the screening system includes one or more spring mechanisms configured to reduce an effort required for a worker to adjust the screen panel from the lower, closed position to the upper, open position.

27. The screening system of claim 26 wherein the one or more spring mechanisms comprise two pretensioned springs operably coupled with the screen panel, wherein the screen panel comprises a fabric screen and a base rail attached to the fabric screen, and each of the two pretensioned springs is received by a drum mounted on the base rail.

28. The screening system of claim 1 wherein the HVAC equipment has a generally rectangular configuration and includes four corner regions, the screening system further including four mount assemblies attached respectively to the four corner regions of the HVAC equipment, wherein each of the four corner regions of the HVAC equipment includes a top corner area and a bottom corner area, wherein at each of the four corner regions of the HVAC equipment one of the four mount assemblies comprises a first plurality of beams anchored to the bottom corner area and a second plurality of beams anchored to the top corner area, and wherein one or more of the first plurality of beams are adjustable in length, and one or more of the second plurality of beams are adjustable in length.

29. The screening system of claim 28 wherein the screening system only has mount assemblies at the four corner regions of the HVAC equipment, such that the screening system has support beams extending outwardly from the HVAC equipment to support the walls of the screening system only at the four corner regions of the HVAC equipment.

30. The screening system of claim 1 wherein the screen panel is adjustable between the lower, closed position and the upper, open position by moving at least part of the screen panel vertically.

31. The screening system of claim 5 wherein the screening system is configured such that, when the screen panel is in the upper, open position, a person can walk through the open doorway and along an adjacent face of the HVAC equipment without encountering a lower horizontal frame member adjacent the roof of the building that could create a tripping hazard.

32. The screening system of claim 10 wherein the screening system only has mount assemblies at the four corner regions of the HVAC equipment, such that the screening system has support beams extending outwardly from the HVAC equipment to support the walls of the screening system only at the four corner regions of the HVAC equipment.

33. The screening system of claim 10 wherein the screen panel comprises a fabric screen formed of an opaque fabric that is substantially impervious to wind.

34. The screening system of claim 15 wherein the screen panel is adjustable between the lower, closed position and the upper, open position by moving at least part of the screen panel vertically.

35. The screening system of claim 23 wherein when the screen panel is in the lower, closed position the fabric screen is held at tension of between 15 and 45 pounds per linear inch.

* * * * *